US010991493B2

(12) United States Patent
Okawa et al.

(10) Patent No.: US 10,991,493 B2
(45) Date of Patent: Apr. 27, 2021

(54) RARE EARTH MAGNET

(71) Applicant: TDK CORPORATION, Tokyo (JP)

(72) Inventors: Wakako Okawa, Tokyo (JP); Syota Goto, Tokyo (JP); Yoshinori Fujikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 502 days.

(21) Appl. No.: 15/560,907

(22) PCT Filed: Mar. 25, 2016

(86) PCT No.: PCT/JP2016/059734
§ 371 (c)(1),
(2) Date: Sep. 22, 2017

(87) PCT Pub. No.: WO2016/153057
PCT Pub. Date: Sep. 29, 2016

(65) Prior Publication Data

US 2018/0082772 A1 Mar. 22, 2018

(30) Foreign Application Priority Data

Mar. 25, 2015 (JP) ..... 2015-061888
Mar. 25, 2015 (JP) ..... 2015-061890
Mar. 25, 2015 (JP) ..... JP2015-061889

(51) Int. Cl.
*H01F 1/053* (2006.01)
*H01F 1/057* (2006.01)
(Continued)

(52) U.S. Cl.
CPC ..... *H01F 1/0577* (2013.01); *B22F 3/16* (2013.01); *B22F 3/24* (2013.01); *B22F 9/04* (2013.01); *C22C 28/00* (2013.01); *C22C 30/00* (2013.01); *C22C 38/00* (2013.01); *C22C 38/001* (2013.01); *C22C 38/002* (2013.01); *C22C 38/005* (2013.01); *C22C 38/008* (2013.01);
(Continued)

(58) Field of Classification Search
CPC ..... H01F 1/0577
See application file for complete search history.

(56) References Cited

U.S. PATENT DOCUMENTS 4,773,950 A 9/1988 Fujimura et al.
4,975,129 A 12/1990 Fujimura et al.
(Continued)

FOREIGN PATENT DOCUMENTS

JP S60-32306 A 2/1985
JP H02-149650 A 6/1990
(Continued)

OTHER PUBLICATIONS

Jun. 21, 2016 Search Report issued in International Patent Application No. PCT/JP2016/059734.
(Continued)

*Primary Examiner* — Jophy S. Koshy
(74) *Attorney, Agent, or Firm* — Oliff PLC

(57) ABSTRACT

A rare earth magnet includes main phase grains having an $R_2T_{14}B$ type crystal structure. The main phase grains include Ga. A concentration ratio A (A=αGa/βGa) of the main phase grains is 1.20 or more, where αGa and βGa are respectively a highest concentration of Ga and a lowest concentration of Ga in one main phase grain.

11 Claims, 5 Drawing Sheets

(51) Int. Cl.

| | |
|---|---|
| ***C22C 38/00*** | (2006.01) |
| ***H01F 1/08*** | (2006.01) |
| ***C22C 38/02*** | (2006.01) |
| ***C22C 38/06*** | (2006.01) |
| ***C22C 38/10*** | (2006.01) |
| ***C22C 38/16*** | (2006.01) |
| ***B22F 3/16*** | (2006.01) |
| ***B22F 3/24*** | (2006.01) |
| ***B22F 9/04*** | (2006.01) |
| ***C22C 28/00*** | (2006.01) |
| ***C22C 30/00*** | (2006.01) |
| *B22F 3/00* | (2021.01) |

(52) U.S. Cl.

CPC ..... *C22C 38/02* (2013.01); *C22C 38/06* (2013.01); *C22C 38/10* (2013.01); *C22C 38/16* (2013.01); *H01F 1/057* (2013.01); *H01F 1/0576* (2013.01); *H01F 1/08* (2013.01); *B22F 3/00* (2013.01); *B22F 2003/248* (2013.01); *B22F 2009/044* (2013.01); *B22F 2201/20* (2013.01); *B22F 2301/45* (2013.01); *C22C 2200/00* (2013.01); *C22C 2202/02* (2013.01)

(56) References Cited

U.S. PATENT DOCUMENTS

| | | | |
|---|---|---|---|
| 7,377,985 | B2 | 5/2008 | Zhang et al. |
| 2004/0050454 | A1 | 3/2004 | Sekino et al. |
| 2009/0081071 | A1 | 3/2009 | Yamamoto et al. |
| 2012/0025651 | A1 | 2/2012 | Komuro et al. |
| 2012/0091844 | A1 | 4/2012 | Nakajima |
| 2014/0290803 | A1 | 10/2014 | Kato et al. |
| 2014/0314612 | A1 | 10/2014 | Nakajima et al. |

FOREIGN PATENT DOCUMENTS

| | | | |
|---|---|---|---|
| JP | 2009-242936 | A | 10/2009 |
| JP | 2014-209546 | A | 11/2014 |
| WO | 2002/061769 | A | 1/2002 |

OTHER PUBLICATIONS

Sep. 26, 2017 International Preliminary Report on Patentability issued in International Patent Application No. PCT/JP2016/059734.
Sepehri-Amin, Acta Materialia, vol. 60, p. 819-830. (Year: 2012).
Apr. 30, 2019 Office Action issued in U.S. Appl. No. 15/560,695.
May 1, 2019 Office Action issued in U.S. Appl. No. 15/560,795.
Oct. 9, 2019 Office Action issued in U.S. Appl. No. 15/560,795.
Oct. 10, 2019 Office Action Issued in U.S. Appl. No. 15/560,695.
Sep. 26, 2017 International Preliminary Report on Patentability issued in International Patent Application No. PCT/JP2016/059732.
Jun. 21, 2016 Search Report issued in International Patent Application No. PCT/JP2016/059732.
Jun. 21, 2016 Search Report issued in International Patent Application No. PCT/JP2016/059731.
U.S. Appl. No. 15/560,695, filed Sep. 22, 2017 in the name of Okawa et al.
U.S. Appl. No. 15/560,795, filed Sep. 22, 2017 in the name of Okawa et al.
Apr. 24, 2020 Office Action issued in U.S. Appl. No. 15/560,695.
Oct. 14, 2020 Office Action Issued in U.S. Appl. No. 15/560,695.

RARE EARTH MAGNET

TECHNICAL FIELD

The present invention relates to a rare earth magnet.

BACKGROUND ART

R-T-B based sintered magnets have a high saturation magnetic flux density, and thus are advantageous for achieving downsizing and high efficiency of using equipment and are used for voice coil motors of hard disk drive, motors for various industries, drive motors of hybrid vehicle, and the like. In applying the R-T-B based sintered magnets to the hybrid vehicles or so, the magnets are exposed to a comparatively high temperature, and it is thus particularly important to prevent thermal demagnetization due to heat. To prevent this thermal demagnetization, it is well known that a method for sufficiently enhancing coercivity at room temperature of the R-T-B based sintered magnets is effective.

For example, a method for substituting a part of Nd of an $Nd_2Fe_{14}B$ compound of main phase for heavy rare earth elements, such as Dy and Tb, is known as a method for enhancing coercivity at room temperature of Nd—Fe—B based sintered magnets. For example, Patent Literature 1 discloses a technique for substituting a part of Nd for heavy rare earth elements so as to sufficiently enhance coercivity at room temperature.

Patent Literature 2 discloses a technique for increasing a concentration of heavy rare earth elements only in shell part of a main phase so as to achieve high coercivity with less amount of heavy rare earth elements and prevent decrease in residual magnetic flux density to some degree.

It is pointed out that prevention of magnetic domain wall motion of a reverse magnetic domain generated is also important for improvement in coercivity of rare earth magnets. For example, Patent Literature 3 discloses a technique for improving coercivity by forming fine magnetic hardening products of non-magnetic phase in grains of main phase $R_2T_{14}B$ and thereby pinning magnetic domain wall.

Patent Literature 4 discloses a technique for preventing magnetic domain wall motion and improving coercivity by forming a part in main phase grains. In this part, magnetic properties have been changed from those of main phase.

CITATION LIST

Patent Literature

Patent Literature 1: JP 60-32306 A
Patent Literature 2: WO 2002/061769 A
Patent Literature 3: JP 2-149650 A
Patent Literature 4: JP 2009-242936 A

SUMMARY OF INVENTION

Technical Problem

The present invention has been achieved under the above. It is an object of the invention to provide a rare earth magnet having both improvement in restraint of thermal demagnetization factor and high coercivity at room temperature by controlling a microstructure of a rare earth magnet, more specifically, controlling the microstructure so that elements constituting main phase in main phase grains have a concentration distribution or a concentration gradient.

Solution to Problem

When using an R-T-B based sintered magnet in a high temperature environment of 100° C. to 200° C., it is important that the magnet not be demagnetized or have a small demagnetization rate even if actually exposed to the high temperature environment. In case of using heavy rare earth elements as shown in Patent Literatures 1 and 2, it is unavoidable that residual magnetic flux density decrease due to anti-ferromagnetic coupling between rare earth elements, such as Nd and Dy. The factor of improvement in coercivity due to use of heavy rare earth elements is improvement in crystal magnetic anisotropy energy due to use of heavy rare earth elements. Now, the temperature change of crystal magnetic anisotropy energy becomes large by using heavy rare earth elements. It is thus conceivable that coercivity of a rare earth magnet using heavy rare earth elements decreases rapidly in accordance with high temperature of use environment even if coercivity is high at room temperature. Heavy rare earth elements, such as Dy and Tb, are limited in terms of their production place and amount.

According to Patent Literatures 3 and 4, which disclose a technique for improving coercivity by controlling a microstructure of a sintered magnet, quite a few non-magnetic materials and soft magnetic materials need to be contained in main phase grains, and residual magnetic flux density decreases unavoidably.

The present inventors have earnestly studied the relation between microstructure and magnetic properties of the R-T-B based sintered magnets, and consequently found out that controlling Ga concentration distribution in main phase grains having an $R_2T_{14}B$ type crystal structure can enhance coercivity at room temperature and improve thermal demagnetization factor. As a result, the present invention has been achieved.

That is, the present invention is a rare earth magnet comprising main phase grains having an $R_2T_{14}B$ type crystal structure, wherein the main phase grains comprise Ga (gallium), and a concentration ratio A ($A=\alpha Ga/\beta Ga$) of the main phase grains is 1.20 or more, where $\alpha Ga$ and $\beta Ga$ are respectively a highest concentration of Ga and a lowest concentration of Ga in one main phase grain. This improves coercivity of the rare earth magnet, and restrains demagnetization due to heat and thermal demagnetization factor.

Preferably, the concentration ratio A is 1.50 or more. When the concentration ratio A in the main phase grain is configured to 1.50 or more, thermal demagnetization factor can be further restrained.

Preferably, a position showing $\beta Ga$ is located within 100 nm from an edge part of the main phase grain toward an inner part of the main phase grain. This makes it possible to further restrain thermal demagnetization factor and maintain high residual magnetic flux density.

Preferably, the main phase grain comprises a Ga concentration gradient increasing from an edge part of the main phase grain toward an inner part of the main phase grain, and a region with the Ga concentration gradient has a length of 100 nm or more. This makes it possible to further restrain thermal demagnetization factor.

Preferably, the main phase grain comprises a Ga concentration gradient increasing from an edge part of the main phase grain toward an inner part of the main phase grain, and a region whose absolute value of the Ga concentration gradient is 0.05 atom %/μm or more has a length of 100 nm or more. This configuration makes it possible to further restrain thermal demagnetization factor.

Advantageous Effects of Invention

The present invention can provide a rare earth magnet having a small thermal demagnetization factor, and can provide a rare earth magnet applicable to motors or so used in a high temperature environment.

DESCRIPTION OF EMBODIMENTS

Hereinafter, a preferable embodiment of the present invention will be explained with reference to the attached drawings. Incidentally, a rare earth magnet of the present embodiment is a sintered magnet comprising main phase grains having an $R_2T_{14}B$ type crystal structure and grain boundary phases, where R is one or more of rare earth elements, T is one or more of iron group elements essentially including Fe, and B is boron. Furthermore, the rare earth magnet of the present embodiment also includes the sintered magnet containing various known additive elements and the sintered magnet containing inevitable impurities. Ga (gallium) is contained in the main phase grain.

Figure 1:
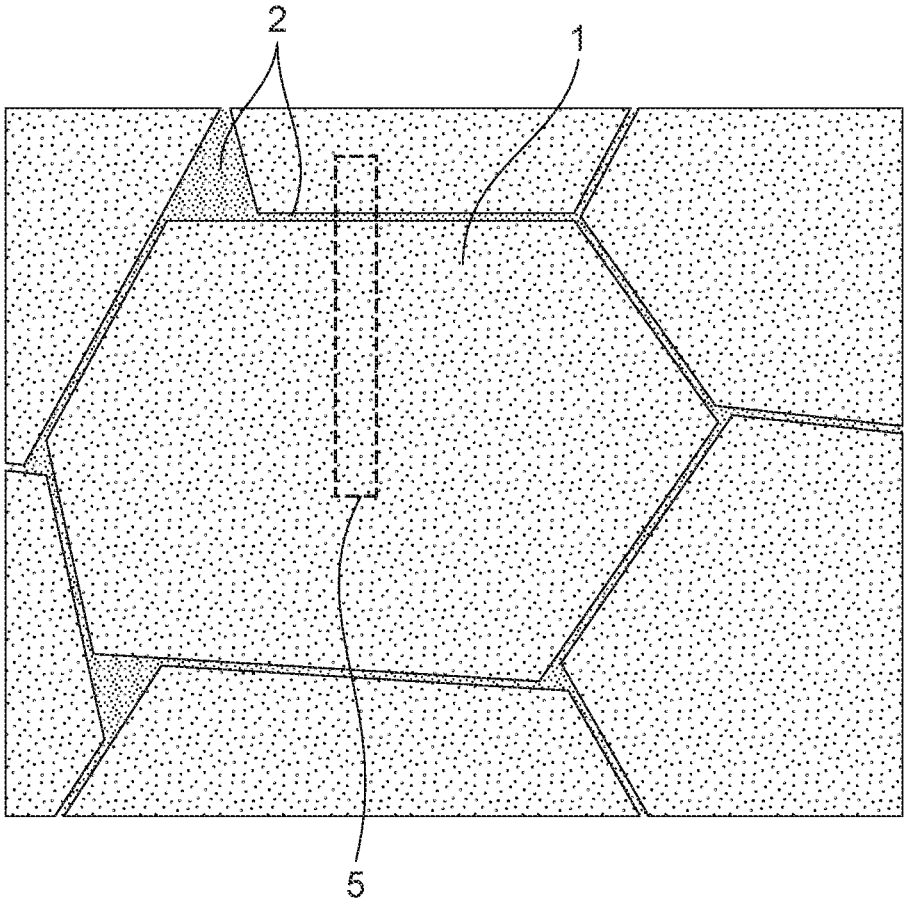
FIG. 1 is a figure schematically showing a sample cut-out part.

As shown in FIG. 1, an R-T-B based sintered magnet according to the present embodiment comprises main phase grains 1 having an $R_2T_{14}B$ type crystal structure and grain boundary phases 2 formed between the adjacent main phase grains having an $R_2T_{14}B$ type crystal structure. The main phase grain 1 having an $R_2T_{14}B$ type crystal structure comprises a concentration difference of Ga in the crystal grain. In the main phase grain 1 having the concentration difference of Ga, a part having a relatively high concentration of Ga and a part having a relatively low concentration of Ga may be anywhere in the main phase grain 1, but the part having a relatively high concentration of Ga is preferably in an inner part of the crystal grain, and the part having a relatively low concentration of Ga is preferably in an outer edge part of the crystal grain. Incidentally, in the crystal grain according to the present embodiment, the outer edge part means a part of the crystal grain comparatively close to the grain boundary phase 2, and the inner part means a part of the crystal grain inside the outer edge part.

The main phase grain 1 having an $R_2T_{14}B$ type crystal structure may contain C, and preferably has a concentration difference of C in the crystal grain. In the main phase grain 1 having the concentration difference of C, a part having a relatively high concentration of C and a part having a relatively low concentration of C may be anywhere in the main phase grain 1, but the part having a relatively high concentration of C is preferably in the inner part of the crystal grain, and the part having a relatively low concentration of C is preferably in the outer edge part of the crystal grain.

Preferably, the main phase grain 1 having an $R_2T_{14}B$ type crystal structure has a concentration difference of B in the crystal grain. In the main phase grain 1 having the concentration difference of B, a part having a relatively high concentration of B and a part having a relatively low concentration of B may be anywhere in the main phase grain 1, but the part having a relatively high concentration of B is preferably in the outer edge part of the crystal grain, and the part having a relatively low concentration of B is preferably in the inner part of the crystal grain.

In the main phase grain 1 having an $R_2T_{14}B$ type crystal structure constituting the rare earth magnet according to the present embodiment, the rare earth R may be a light rare earth element (a rare earth element having an atomic number of 63 or less), a heavy rare earth element (a rare earth element having an atomic number of 64 or more), or a combination of the light rare element and the heavy rare earth element, but is preferably Nd, Pr, or a combination of Nd and Pr from a viewpoint of material cost. The other elements are as mentioned above. A preferable combination range of Nd and Pr will be mentioned below.

The rare earth magnet according to the present embodiment may contain a very small amount of additive elements. The additive elements may include a known element. The additive elements preferably include an additive element having eutectic composition with an R element of a constituent element of the main phase grain having an $R_2T_{14}B$ type crystal structure. From this viewpoint, the additive elements preferably include Cu, but may include the other elements. A preferable range of additive amount of Cu in case of containing Cu as additive element will be mentioned below.

The rare earth magnet according to the present embodiment further contains Al, Ga, Si, Ge, Sn, etc. as a M element for accelerating a reaction of the main phase grain 1 in a powder metallurgical step. A preferable range of additive amount of the M element will be mentioned below. When the M elements are added to the rare earth magnet in addition to Cu mentioned above, a reaction between the outer edge part of the main phase grain 1 and the grain boundary phase 2 is accelerated, and some of the R and T elements and Ga in the outer edge part of the main phase grain 1 start moving to the grain boundary phase 2. Thus, a Ga concentration of the outer edge part of the main phase grain 1 can be relatively lower than that of the inner part of the main phase grain 1, and a part whose magnetic properties have been changed is formed in the main phase grain 1. The M elements and Cu may be contained in the main phase grain 1.

In the rare earth magnet according to the present embodiment, contents of the above-mentioned respective elements with respect to the total mass are respectively as below, but the contents of the above-mentioned respective elements are not limited to the following numerical ranges.

R: 29.5 to 35.0 mass %
B: 0.7 to 0.98 mass %
M: 0.03 to 1.7 mass %
Cu: 0.01 to 1.5 mass %
Fe: substantial remaining part
total content of element(s) other than Fe occupying the remaining part: 5.0 mass % or less Preferably, Ga of M is contained at 0.03 to 1.5 mass %. When Ga of M is contained at 0.08 to 1.2 mass %, a green compact has a higher strength. When Al of M is contained at 0.1 to 0.5 mass %, a green compact has a higher strength.

R contained in the rare earth magnet according to the present embodiment will be explained in more detail. R is preferably contained at 31.5 to 35.0 mass %. R preferably includes one of Nd and Pr, and more preferably includes both Nd and Pr. A ratio of Nd and Pr in R is preferably 80 to 100 atom % in total of Nd and Pr. When a ratio of Nd and Pr in R is 80 to 100 atom %, more favorable residual magnetic flux density and coercivity can be obtained. When both Nd and Pr are contained, a ratio of Nd in R and a ratio of Pr in R are preferably 10 mass % or more, respectively.

The rare earth magnet according to the present embodiment may contain the heavy rare earth element(s) of Dy, Tb, etc. as R. In this case, the content of the heavy rare earth element(s) with respect to the total mass of the rare earth magnet is preferably 10 mass % or less, more preferably 5 mass % or less, and even more preferably 2 mass % or less in total of the heavy rare earth element(s). In the rare earth magnet according to the present embodiment, it is possible to obtain a favorably high coercivity and restrain a thermal demagnetization factor by forming a Ga concentration difference in the main phase grain 1 even if a small amount of the heavy rare earth element is contained.

Now, a thermal demagnetization factor of the rare earth magnet according to the present embodiment is explained. A sample has a shape where permeance coefficient is 2, as normally frequently used. First, an amount of magnetic flux of a sample at a room temperature (25° C.) is measured and defined as B0. The amount of magnetic flux can be measured by a flux meter, for example. Next, the sample is exposed at a high temperature of 140° C. for 2 hours, and the temperature is returned to the room temperature. After the sample temperature is returned to the room temperature, an amount of magnetic flux is measured once again and is defined as B1. Then, a thermal demagnetization factor D is represented as below.

$$D=100*(B1-B0)/B0(\%)$$

In the rare earth magnet according to the present embodiment, B is preferably contained at 0.7 to 0.98 mass %, and is more preferably contained at 0.80 to 0.93 mass %. When a content of B is in a specific range that is less than stoichiometric ratio expressed by $R_2T_{14}B$, it is possible to facilitate a reaction of the surface of the main phase grain along with the additive element in the powder metallurgical step. When a content of B is less than stoichiometric ratio, it is conceivable that defects of B are generated in the main phase grain 1. Elements like C mentioned below enter the defects of B, but it is conceivable that elements like C do not enter all of the defects of B, and some of the defects may remain as they are.

The rare earth magnet according to the present embodiment further contains a very small amount of additive elements. The additive elements may include a known element. The additive elements preferably have a eutectic point with an R element of a constituent element of the main phase grain 1 having an $R_2T_{14}B$ type crystal structure in a phase diagram. From this viewpoint, the additive elements are preferably Cu, but may be another element. When Cu is added as the additive elements, an additive amount of Cu element is preferably 0.01 to 1.5 mass %, more preferably 0.05 to 0.5 mass % of the whole. When the additive amount is in this range, Cu can be distributed unevenly in the grain boundary phase 2.

Furthermore, Zr and/or Nb may be added as the additive elements. A total content of Zr and Nb is preferably 0.05 to 0.6 mass %, more preferably 0.1 to 0.2 mass %. When Zr and/or Nb is/are added, there is an effect of restraining grain growth.

On the other hand, in T element of a constituent element of the main phase grain 1 and Cu, for example, it is conceivable that a phase diagram of Fe and Cu is like monotectic type, and this combination is conceivably hard to form a eutectic point. It is then preferable to add an M element where R-T-M ternary forms a eutectic point. This M element includes Al, Ga, Si, Ge, Sn, etc. This M element is contained preferably at 0.03 to 1.7 mass %, more preferably at 0.1 to 1.7 mass %, and even more preferably at 0.7 to 1.0 mass %. When the content of the M element is in this range, a reaction of the surface of the main phase grain is accelerated in a powder metallurgical step, some of R and T elements and Ga in the outer edge part of the main phase grain 1 start moving to the grain boundary phase 2, and a low Ga concentration can be obtained in the outer edge part of the main phase grain 1. The M element may be also contained in the main phase grain 1.

In addition to Fe essentially contained, the rare earth magnet according to the present embodiment may further contain another iron group element as the element expressed as T of $R_2T_{14}B$. This iron group element is preferably Co. In this case, Co is preferably contained at more than 0 mass % and 3.0 mass % or less. When Co is contained in the rare earth magnet, a curie temperature improves (becomes higher), and corrosion resistance also improves. Co may be contained at 0.3 to 2.5 mass %.

In the rare earth magnet according to the present embodiment, the grain boundary phase 2 of a sintered body contains R-T-M elements. A concentration difference of Ga can be generated in the main phase grain 1 by adding the rare earth element R and iron group element T of constituent elements of the main phase grain 1 and further adding the M element for forming a ternary eutectic point along with R and T. The reason why a concentration difference of Ga is generated is that a reaction between the outer edge part of the main phase grain 1 and the grain boundary phase 2 is accelerated by adding the M element, some of the R and T elements and Ga in the outer edge part of the main phase grain 1 start moving to the grain boundary phase 2, and a low concentration of Ga is obtained in the outer edge part of the main phase grain 1. In this reaction, a nonmagnetic material and a soft magnetic material are not newly formed in the main phase grain 1, and there is no lowering of residual magnetic flux density due to a nonmagnetic material and a soft magnetic material.

The M element for accelerating the reaction along with the R and T elements constituting the main phase grain 1 includes Al, Ga, Si, Ge, Sn, etc.

A microstructure of the rare earth magnet according to the present embodiment can be evaluated by performing a three-dimensional atom probe measurement using a three-dimensional atom probe microscope, for example. Incidentally, a measurement method of the microstructure of the rare earth magnet according to the present embodiment is not limited to the three-dimensional atom probe measurement. The three-dimensional atom probe measurement is a measurement method capable of evaluating and analyzing a three-dimensional element distribution with atomic order. In the three-dimensional atom probe measurement, an electric field evaporation is generated normally by applying a voltage pulse, but a laser pulse may be used instead of the voltage pulse. A specimen is partially cut out from the sample evaluated in terms of thermal demagnetization factor to have a needle-like shape, and the three-dimensional atom probe measurement is carried out. Before the needle-like specimen is cut out from the sample, an electron microscope image of a polished cross section of the main phase grain is obtained. A magnification is appropriately determined so that about 100 main phase grains can be observed on the polished cross section to be observed. Grains whose grain size is larger than an average grain size of the main phase grains in the obtained electron microscope image are selected, and the needle-like specimen is sampled so that a central area of the main phase grain 1 is included as shown in FIG. 1. The needle-like specimen may have a longitudinal direction parallel to an orientation axis, perpendicular to the orientation axis, or inclined to the orientation axis by an angle. The three-dimensional atom probe measurement is carried out continuously from near the main phase grain edge part toward the inner part of the main phase grain at least in 500 nm. A three-dimensionally constituted image obtained by the measurement is divided into unit volumes (e.g. a cube of 50 nm×50 nm×50 nm) on a line from the edge part of the grain toward the inner part of the grain, and an average Ga atom concentration, an average C atom concentration, and an average B atom concentration are calculated in each divided region. A distribution of the Ga atom concentrations, a distribution of the C atom concentrations, and a distribution of the B atom concentrations can be evaluated by graphing the average Ga atom concentrations, the average C atom concentrations, and the average B atom concentrations in the divided regions with respect to a distance between a central point and the main phase grain edge part in the divided region. Incidentally, in the present description, only data of an $R_2T_{14}B$ type compound phase of the main phase grain 1 is adopted, and the evaluation is not conducted in a heterogenous phase contained in the main phase grain 1.

In the present embodiment, the main phase grain edge part (boundary part between main phase grain 1 and grain boundary phase 2) is defined as a part where a Cu atom concentration is twice as much as an average value of Cu atom concentrations in a 50 nm length outer edge part of the main phase grain 1.

Figure 4A:
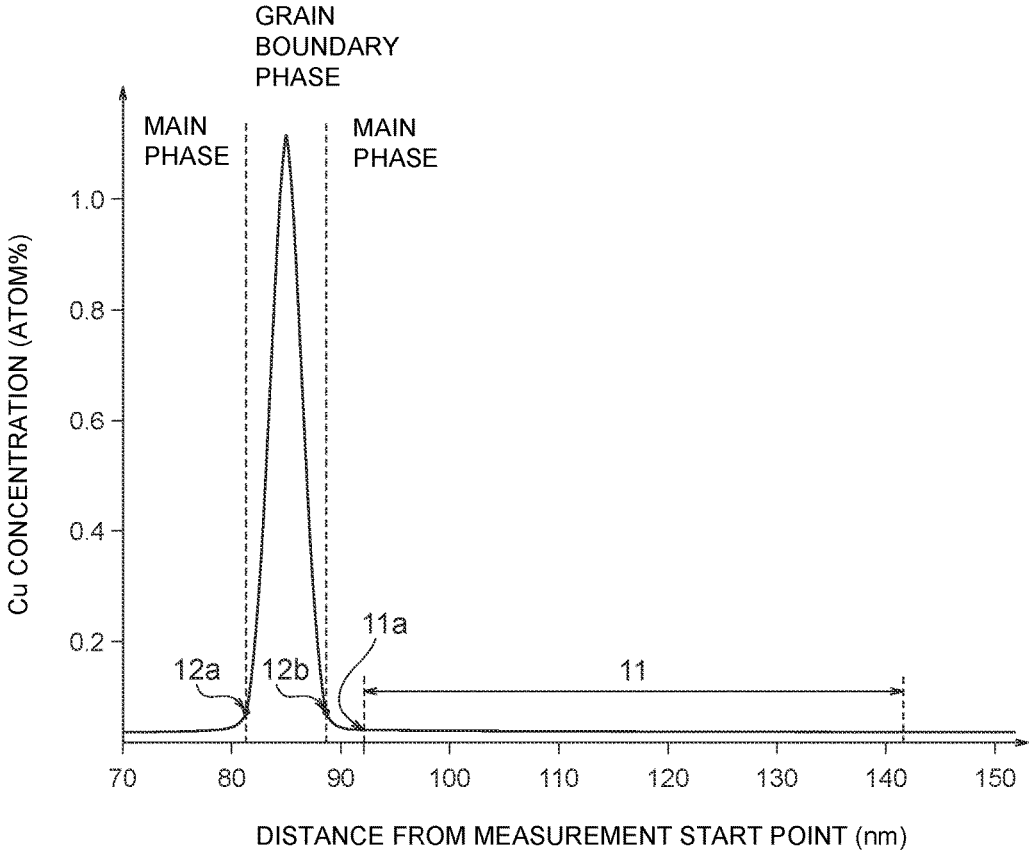
FIG. 4A is a figure showing a definition of a main phase grain edge part of the present invention.
Figure 4B:
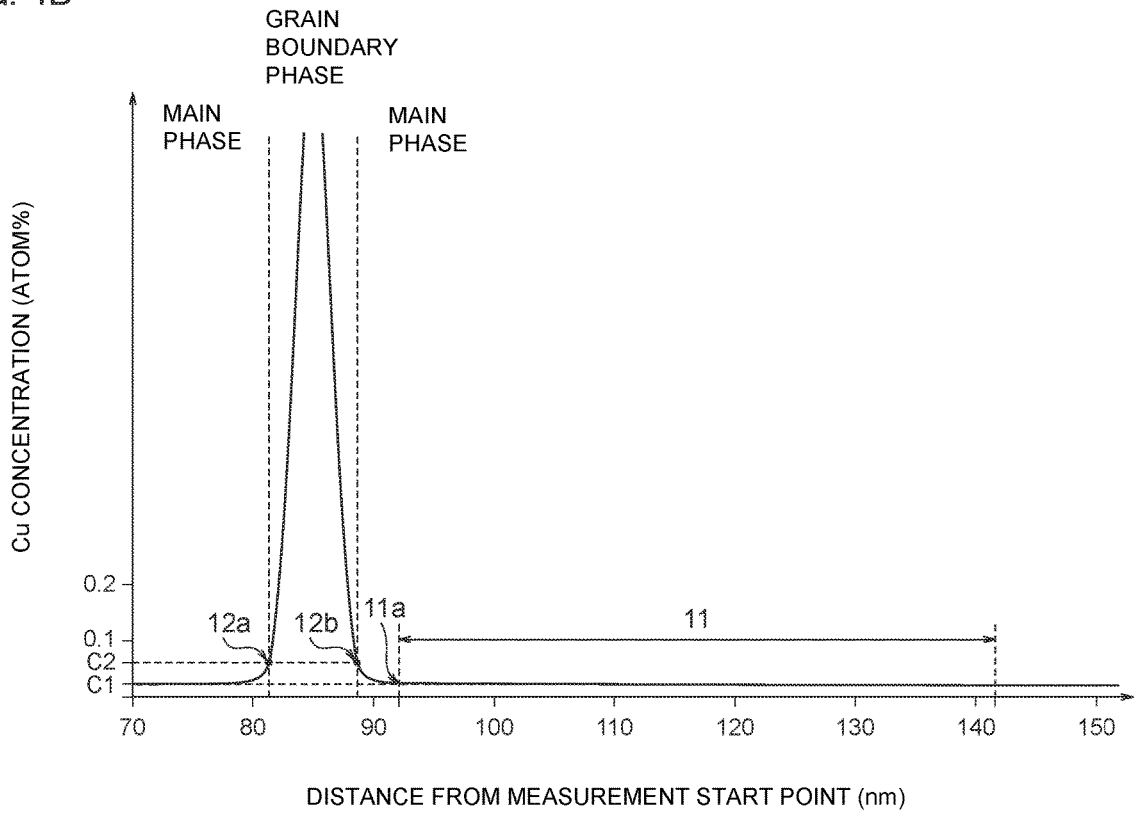
FIG. 4B corresponds to FIG. 4A except for having a vertical axis whose scale is changed from that of FIG. 4A.

FIG. 4A and FIG. 4B are used to further explain the 50 nm length outer edge part and the main phase grain edge part. FIG. 4A and FIG. 4B are a graph showing a variation of the Cu atom concentration in the vicinity of the boundary part between the main phase grain 1 and the grain boundary phase 2. There is no limit to the measurement method of the Cu atom concentration in the preparation of the graph. For example, the three-dimensional atom probe measurement can be employed in the same manner as the above-mentioned distribution of Ga atom concentration. When using the three-dimensional atom probe for the measurement of Cu atom concentration, one side in the same direction as the direction from the main phase grain edge part toward the inner part of the unit volume preferably has a length of 1 to 5 nm. The unit volume is preferably 1000 $nm^3$ or more (e.g., a rectangular parallelepiped of 50 nm×50 nm×2 nm). When using another measurement method, measurement intervals of Cu atom concentration are preferably 1 to 5 nm.

In the present embodiment, the 50 nm length outer edge part 11 is where Cu atom concentrations are approximately constant in the outer edge part of the main phase grain shown in FIG. 4A and FIG. 4B, and the main phase grain edge parts 12*a* and 12*b* are where a Cu atom concentration shown in FIG. 4A and FIG. 4B is twice as much as an average value of Cu atom concentrations in the 50 nm length outer edge part 11. Incidentally, the 50 nm length outer edge part 11 is preferably positioned so as not to be excessively distant from the grain boundary phase 2, and specifically, is preferably configured so that a distance between an end 11*a* of the 50 nm length outer edge part 11 and the main phase grain edge part 12*b* is within 50 nm. As shown in FIG. 4A, in the present embodiment, the Cu atom concentration is high in the grain boundary phase 2 and is low in the main phase grains 1. As shown in FIG. 4B, an average of Cu atom concentrations in the 50 nm length outer edge part 11 of the main phase grain 1 where Cu atom concentrations are approximately constant (C1 in FIG. 4B) is calculated, and parts where a Cu atom concentration is twice as much as the average concentration are defined as the main phase grain edge parts 12*a* and 12*b*. That is, C2=C1×2 is satisfied.

The position of the 50 nm length outer edge part 11 of the main phase grain 1 is not constant, but a variation of the average C1 of Cu atom concentrations due to a positional variation of the 50 nm length outer edge part 11 of the main phase grain 1 is within an error range. Positional variations of the main phase grain edge parts 12*a* and 12*b* due to the positional variation of 50 nm length outer edge part 11 of the main phase grain 1 are also within error ranges.

The rare earth magnet according to the present embodiment comprises main phase grains having a concentration ratio A (A=αGa/βGa) of 1.20 or more, where αGa and βGa are respectively a highest concentration of Ga and a lowest concentration of Ga in one main phase grain. In this configuration, there appears a distribution of magnetocrystalline anisotropy in the main phase grains, and it is possible to provide a rare earth magnet having both improvement in restraint of thermal demagnetization factor and high coercivity at room temperature. A ratio of the main phase grains having a desired concentration ratio A with respect to all main phase grains is preferably 10% or more, more preferably 50% or more, and even more preferably 90% or more. In case of 90% or more, thermal demagnetization factor can be further improved.

Furthermore, the rare earth magnet according to the present embodiment preferably comprises main phase grains having a concentration ratio A (A=αGa/βGa) of 1.50 or more, where αGa and βGa are respectively a highest concentration of Ga and a lowest concentration of Ga in one main phase grain. When the main phase grains having a desired value of the concentration ratio A are contained, it is possible to provide a rare earth magnet having both improvement in restraint of thermal demagnetization factor and high coercivity at room temperature. A ratio of the main phase grains having a desired concentration ratio A with respect to all main phase grains is preferably 10% or more, more preferably 50% or more, and even more preferably 70% or more. In case of 70% or more, thermal demagnetization factor and coercivity can be further improved.

Furthermore, the rare earth magnet according to the present embodiment comprises main phase grains where a position showing βGa is located within 100 nm from an edge part of the main phase grain toward an inner part of the main phase grain, and these main phase grains are contained preferably at 10% or more, more preferably at 50% or more, and even more preferably at 70% or more. In this configuration, a part whose magnetic properties have been changed from those of the inner part of the main phase grain is formed in the outer edge part of the main phase grain, and it is possible to generate a gap of anisotropy magnetic field between the outer edge part and inner part of the main phase grain. This does not accompany an anti-ferromagnetic couple of Nd and Dy, for example, and thus does not accompany lowering of residual magnetic flux density. When the main phase grains are contained, it is thus possible to provide a rare earth magnet having both further prevention of thermal demagnetization factor and further improvement in coercivity at room temperature. In case of 70% or more, thermal demagnetization factor and coercivity can be further improved.

Furthermore, the rare earth magnet according to the present embodiment comprises main phase grains including a Ga concentration gradient increasing from an edge part of the main phase grain toward an inner part of the main phase grain, wherein a region with the Ga concentration gradient has a length of 100 nm or more, and these main phase grains are contained preferably at 10% or more, more preferably at 50% or more. When the main phase grains are contained, it is thus possible to provide a rare earth magnet having both further restraint of thermal demagnetization factor and further improvement in coercivity at room temperature. In case of 50% or more, thermal demagnetization factor can be further improved.

Furthermore, the rare earth magnet according to the present embodiment comprises main phase grains including a Ga concentration gradient increasing from an edge part of the main phase grain toward an inner part of the main phase grain, wherein a region whose absolute value of the Ga concentration gradient is 0.05 atom %/μm or more has a length of 100 nm or more, and these main phase grains are contained preferably at 10% or more, more preferably at 50% or more. In this configuration, a region where crystal magnetic anisotropy changes rapidly can be formed in the outer edge part of the main phase grain. When the main phase grains are contained, it is thus possible to provide a rare earth magnet having both further restraint of thermal demagnetization factor and further improvement in coercivity at room temperature. In case of 50% or more, thermal demagnetization factor can be further improved.

The rare earth magnet according to the present embodiment preferably comprises main phase grains having a concentration ratio A1 (A1=αC/βC) of 1.50 or more, where αC and βC are respectively a highest concentration of C and a lowest concentration of C in one main phase grain. In this configuration, there appears a distribution of magnetocrystalline anisotropy in the main phase grains, and it becomes easier to provide a rare earth magnet having both easy improvement in restraint of thermal demagnetization factor and high coercivity at room temperature. A ratio of the main phase grains having a desired concentration ratio A1 with respect to all main phase grains is preferably 10% or more, more preferably 50% or more, and even more preferably 90% or more. In case of 90% or more, thermal demagnetization factor can be further improved.

Furthermore, the rare earth magnet according to the present embodiment preferably comprises main phase grains having a concentration ratio A1 of (A1=αC/βC) of 2.00 or more, where αC and βC are respectively a highest concentration of C and a lowest concentration of C in one main phase grain. When the main phase grains having a desired value of the concentration ratio A1 are contained, it is possible to provide a rare earth magnet having both improvement in restraint of thermal demagnetization factor and high coercivity at room temperature. A ratio of the main phase grains having a desired concentration ratio A1 with respect to all main phase grains is preferably 10% or more, more preferably 50% or more, and even more preferably 70% or more. In case of 70% or more, thermal demagnetization factor and coercivity can be further improved.

Furthermore, the rare earth magnet according to the present embodiment comprises main phase grains where a position showing βC is located within 100 nm from an edge part of the main phase grain toward an inner part of the main phase grain, and these main phase grains are contained preferably at 10% or more, more preferably at 50% or more, and even more preferably at 70% or more. In this configuration, a part whose magnetic properties have been changed from those of the inner part of the main phase grain is formed in the outer edge part of the main phase grain, and it is possible to generate a gap of anisotropy magnetic field between the outer edge part and inner part of the main phase grain. This does not accompany an anti-ferromagnetic couple of Nd and Dy, for example, and thus does not accompany lowering of residual magnetic flux density. When the main phase grains are contained, it is thus possible to provide a rare earth magnet having both further prevention of thermal demagnetization factor and further improvement in coercivity at room temperature. In case of 70% or more, thermal demagnetization factor and coercivity can be further improved.

Furthermore, the rare earth magnet according to the present embodiment comprises main phase grains including a C concentration gradient increasing from an edge part of the main phase grain toward an inner part of the main phase grain, wherein a region with the C concentration gradient has a length of 100 nm or more, and these main phase grains are contained preferably at 10% or more, more preferably at 50% or more. When the main phase grains are contained, it is thus possible to provide a rare earth magnet having both further restraint of thermal demagnetization factor and further improvement in coercivity at room temperature. In case of 50% or more, thermal demagnetization factor can be further improved.

Furthermore, the rare earth magnet according to the present embodiment comprises main phase grains including a C concentration gradient increasing from an edge part of the main phase grain toward an inner part of the main phase grain, wherein a region whose absolute value of the C concentration gradient is 0.00010 atom %/nm or more has a length of 100 nm or more, and these main phase grains are contained preferably at 10% or more, more preferably at 50% or more. In this configuration, a region where crystal magnetic anisotropy changes rapidly can be formed in the outer edge part of the main phase grain. When the main phase grains are contained, it is thus possible to provide a rare earth magnet having both further restraint of thermal demagnetization factor and further improvement in coercivity at room temperature. In case of 50% or more, thermal demagnetization factor can be further improved.

The rare earth magnet according to the present embodiment preferably comprises main phase grains having a concentration ratio A2 (A2=αB/βB) of 1.05 or more, where αB and βB are respectively a highest concentration of B and a lowest concentration of B in one main phase grain. In this configuration, there appears a distribution of magnetocrystalline anisotropy in the main phase grains, and it becomes easier to provide a rare earth magnet having both easy improvement in restraint of thermal demagnetization factor and high coercivity at room temperature. A ratio of the main phase grains having a desired concentration ratio A2 with respect to all main phase grains is preferably 10% or more, more preferably 50% or more, and even more preferably 90% or more. In case of 90% or more, thermal demagnetization factor can be further improved.

The rare earth magnet according to the present embodiment preferably comprises main phase grains having a concentration ratio A2 (A2=αB/βB) of 1.08 or more, where αB and βB are respectively a highest concentration of B and a lowest concentration of B in one main phase grain. When the main phase grains having a desired concentration ratio A2 are contained, it is possible to provide a rare earth magnet having both improvement in restraint of thermal demagnetization factor and high in coercivity at room temperature. A ratio of the main phase grains having a desired concentration ratio A2 with respect to all main phase grains is preferably 10% or more, more preferably 50% or more, and even more preferably 70% or more. In case of 70% or more, thermal demagnetization factor and coercivity can be further improved.

Furthermore, the rare earth magnet according to the present embodiment comprises main phase grains where a position showing aB is located within 100 nm from an edge part of the main phase grain toward an inner part the main phase grain, and these main phase grains are contained preferably at 10% or more, more preferably at 50% or more, and even more preferably at 70% or more. In this configuration, a part whose magnetic properties have been changed from those of the inner part of the main phase grain is formed in the outer edge part of the main phase grain, and it is possible to generate a gap of anisotropy magnetic field between the outer edge part and inner part of the main phase grain. This does not accompany an anti-ferromagnetic couple of Nd and Dy, for example, and thus does not accompany lowering of residual magnetic flux density. When the main phase grains are contained, it is thus possible to provide a rare earth magnet having both further prevention of thermal demagnetization factor and further improvement in coercivity at room temperature. In case of 70% or more, thermal demagnetization factor and coercivity can be further improved.

Furthermore, the rare earth magnet according to the present embodiment comprises main phase grains including a B concentration gradient decreasing from an edge part of the main phase grain toward an inner part of the main phase grain, wherein a region with the B concentration gradient has a length of 100 nm or more, and these main phase grains are contained preferably at 10% or more, more preferably at 50% or more. When the main phase grains are contained, it is thus possible to provide a rare earth magnet having both further restraint of thermal demagnetization factor and further improvement in coercivity at room temperature. In case of 50% or more, thermal demagnetization factor can be further improved.

Furthermore, the rare earth magnet according to the present embodiment comprises main phase grains including a B concentration gradient decreasing from an edge part of the main phase grain toward an inner part of the main phase grain, wherein a region whose absolute value of the B concentration gradient is 0.0005 atom %/nm or more has a length of 100 nm or more, and these main phase grains are contained preferably at 10% or more, more preferably at 50% or more. In this configuration, a region where crystal magnetic anisotropy changes rapidly can be formed in the outer edge part of the main phase grain. When the main phase grains are contained, it is thus possible to provide a rare earth magnet having both further restraint of thermal demagnetization factor and further improvement in coercivity at room temperature. In case of 50% or more, thermal demagnetization factor can be further improved.

The rare earth magnet according to the present embodiment may contain C as another element. C is preferably contained at 0.05 to 0.3 mass %. When C is contained less than this range, coercivity may be insufficient. When C is contained more than this range, a so-called squareness ratio (Hk/HcJ), which is a ratio of a value of a magnetic field when magnetization is 90% of residual magnetic flux density (Hk) to coercivity (HcJ), may be insufficient. For having further favorable coercivity and squareness ratio, C is contained preferably at 0.1 to 0.25 mass %. C may be contained in the main phase grains 1 in such a manner that a part of B of the main phase grains 1 having an $R_2T_{14}B$ type crystal structure is substituted for C.

The rare earth magnet according to the present embodiment may contain O as another element. O is preferably contained at 0.03 to 0.4 mass %. When O is contained less than this range, corrosion resistance of the sintered magnet may be insufficient. When O is contained more than this range, a liquid phase is not formed sufficiently in the sintered magnet, and coercivity may be decreased. For further favorably obtaining corrosion resistance and coercivity, O is contained more preferably at 0.05 to 0.3 mass %, even more preferably at 0.05 to 0.25 mass %. O may be also contained in the main phase grain.

The rare earth magnet according to the present embodiment contains N preferably at 0.15 mass % or less. When N is contained more than this range, coercivity tends to be insufficient. N may be also contained in the main phase grains 1.

In the sintered magnet according to the present embodiment, each element is contained preferably at the above-mentioned ranges, and a relation of $[O]/([C]+[N])<0.85$ is preferably satisfied, where [C], [O], and [N] are the number of atoms of C, O, and N, respectively. In this configuration, an absolute value of thermal demagnetization factor can be restrained to be small. In the sintered magnet according to the present embodiment, the number of atoms of C and M elements preferably satisfies the following relation. That is, a relation of $1.20<[M]/[C]<2.00$ is preferably satisfied, where [C] and [M] are the number of atoms of C and M elements, respectively. In this configuration, both high residual magnetic flux density and restraint of thermal demagnetization factor can be obtained.

The crystal grain preferably has a grain size of 1 to 8 μm, and more preferably has a grain size of 2 to 6 μm. In case of the upper limit or more, coercivity HcJ tends to decrease. In case of the lower limit, residual magnetic flux density Br tends to decrease. Incidentally, a grain size of the crystal grain is an average of circle equivalent diameters on its cross section.

Next, a manufacturing method of the rare earth magnet according to the present embodiment will be explained. The rare earth magnet according to the present embodiment can be manufactured by an ordinary powder metallurgical method. This powder metallurgical method includes a preparation step of preparing a raw material alloy, a pulverization step of pulverizing the raw material alloy and obtaining a raw material fine powder, a pressing step of pressing the raw material fine powder and manufacturing a green compact, a sintering step of sintering the green compact and obtaining a sintered body, and a heat treatment step of performing an aging treatment to the sintered body.

The preparation step is a step of preparing a raw material alloy having each element contained in the rare earth magnet according to the present embodiment. First, raw material metals having predetermined elements or so are prepared and used to perform a strip casting or so. This makes it possible to prepare a raw material alloy. The raw material metals or so include rare earth metals, rare earth alloys, pure iron, ferro-boron, carbon, and alloys of these, for example. These raw material metals or so are used to prepare a raw material alloy for obtaining a rare earth magnet having a desired composition.

The strip casting method is explained as a preparation method. In the strip casting method, a molten metal is poured into a tundish, and the molten metal where the raw material metals or so are melted is poured from the tundish onto a rotating copper roll whose inside is water-cooled and is cooled and solidified. A cooling rate during the solidification can be controlled in a desired range by adjusting temperature and supply amount of the molten metal and rotating speed of the cooling roll. The cooling rate during the solidification is preferably appropriately determined based on conditions of composition or so of a rare earth magnet to be manufactured, but is 500 to 11000° C./second, preferably 1000 to 11000° C./second, for example. When the cooling rate during the solidification is controlled in this way, it is conceivable that even if the content of B contained in the raw material alloy to be obtained is less than stoichiometric ratio expressed by $R_2T_{14}B$, tetragonal $R_2T_{14}B$ type crystal structure can be maintained in a metastable state, and concentration differences of Ga, C, and B can be generated in the main phase grains in the heat treatment step or so mentioned below. The cooling rate during the solidification is specifically calculated in such a manner that a difference between a temperature obtained by measuring a molten metal temperature in the tundish using an immersed thermocouple and a value obtained by measuring an alloy temperature at a position where the roll has been rotated by 60 degrees using a radiation thermometer is divided by a time where the roll has been rotated by 60 degrees.

The amount of carbon contained in the raw material alloy is preferably 100 ppm or more. In this case, it becomes easier to adjust a Ga amount, a C amount, and a B amount of the outer edge part to preferable ranges.

The amount of carbon in the raw material alloy is adjusted by using the raw material metals or so containing carbon, for example. In particular, the amount of carbon is easily adjusted by changing the kind of Fe raw material. The amount of carbon is increased by using carbon steel, cast iron, or the like, and the amount of carbon is decreased by using electrolytic iron or so.

The pulverization step is a step of pulverizing the raw material alloy obtained in the preparation step and obtaining a raw material fine powder. This step is preferably carried out by two steps of a coarse pulverization step and a fine pulverization step, but may be carried out by one step of the fine pulverization step.

The coarse pulverization step can be carried out in an inert gas atmosphere using a stamp mill, a jaw crusher, a brown mill, or the like. A hydrogen storage pulverization may be carried out. In the coarse pulverization, the raw material alloy is pulverized until a coarse powder having a grain size of about hundreds μm to several mm is obtained.

In the fine pulverization, the coarse powder obtained in the coarse pulverization step (the raw material alloy in case of omitting the coarse pulverization step) is finely pulverized to prepare a raw material fine powder having an average grain size of about several μm. The raw material fine powder has an average grain size determined by considering a growth degree of crystal grains after being sintered. The fine pulverization can be carried out by using a jet mill, for example.

A pulverization aid can be added before the fine pulverization. When a pulverization aid is added, pulverization property is improved, and magnetic field orientation in the pressing step becomes easy. In addition, it becomes possible to change an amount of carbon during sintering and adjust gallium composition, carbon composition, and boron composition in the outer edge part of the main phase grain of the sintered magnet.

From the above reasons, the pulverization aid is preferably a lubricant organic matter. In particular, an organic matter containing nitrogen is preferable for satisfying the above-mentioned relation of $[O]/([C]+[N])<0.85$. Specifically, the pulverization aid is preferably a metal salt of a long-chain hydrocarbon acid, such as stearic acid, oleic acid, and lauric acid, or an amide of the long-chain hydrocarbon acid.

From a viewpoint of composition control of the outer edge part, an additive amount of the pulverization aid is preferably 0.05 to 0.15 mass % with respect to the raw material alloy of 100 mass %. When a mass ratio of the pulverization aid to carbon contained in the raw material alloy is 5 to 15, it is possible to adjust gallium composition, carbon composition, and boron composition of the outer edge part and inner part of the main phase grain of the sintered magnet.

The pressing step is a step of pressing the raw material fine powder in a magnetic field and manufacturing a green compact. Specifically, the green compact is manufactured by conducting the pressing in such a manner that the raw material fine powder is filled in a press mold arranged in an electromagnet, and the raw material fine powder is thereafter pressurized while the electromagnet is used to apply a magnetic field to orient crystal axes of the raw material fine powder. The pressing in magnetic field is carried out at about 30 to 300 MPa in a magnetic field of 1000 to 1600 kA/m, for example.

The sintering step is a step of sintering the green compact and obtaining a sintered body. The sintered body can be obtained by sintering the green compact in a vacuum or in an inert gas atmosphere after the pressing in magnetic field. The sintering conditions are appropriately determined depending upon conditions of composition of the green compact, pulverization method of the raw material fine powder, powder size, and the like. For example, the sintering step is carried out at 950° C. to 1250° C. for 1 to 10 hours, but is preferably carried out at 1000° C. to 1100° C. for 1 to 10 hours. The amount of carbon during sintering can be adjusted by adjusting a temperature rising process. A temperature rising speed from a room temperature to 300° C. is desirably 1° C./minute or more, more desirably 4° C./minute or more, so that carbon remains until sintering. A treatment of generating concentration differences of Ga, C, and B in the main phase grain may be carried out in the sintering step, in the heat treatment step mentioned below, or the like.

The heat treatment step is a step of performing an aging treatment to the sintered body. Concentration differences of Ga, C, and B can be generated in the main phase grain via this step. A microstructure in the main phase grains, however, is not controlled only by this step, but is determined by a combination with the conditions of the above-mentioned sintering step and the state of the raw material fine powder. Thus, the heat treatment temperature and time are determined by considering a relation between the heat treatment conditions and a microstructure of the sintered body. The heat treatment is carried out in a temperature range of 500° C. to 900° C., but may be carried out by two steps in such a manner that a heat treatment at around 800° C. is carried out, and a heat treatment at around 550° C. is thereafter carried out. The microstructure is changed also by a cooling rate in a temperature decreasing process of the heat treatment. The cooling rate is 50° C./minute or more, especially 100° C./minute or more, and is preferably 250° C./minute or less, especially 200° C./minute or less. Concentration distributions of Ga, C, and B in the main phase grain can be controlled variously by determining raw material alloy composition, cooling rate at the time of solidification in the preparation step, the above-mentioned sintering conditions and heat treatment conditions, and the like.

The present embodiment shows a method for controlling Ga, C, and B concentration distributions in the main phase grain, but the rare earth magnet of the present invention is not limited to one obtained by this method. A rare earth magnet demonstrating similar effects can be obtained even in different conditions from the heat treatment conditions or so shown in the present embodiment by adding a control of composition factors, a control of solidification conditions in the preparation step, and a control of sintering conditions.

The rare earth magnet according to the present embodiment is obtained by the above-mentioned method, but the manufacturing method of the rare earth magnet according to the present invention is no limited to the above-mentioned method and may be changed appropriately. The rare earth magnet according to the present embodiment is used for anything, and for example, is favorably used for voice coil motors of hard disk drive, motors for industrial machine, and motors for household electric appliances. Furthermore, the rare earth magnet according to the present embodiment is also favorably used for automobile components, especially EV components, HEV components, and FCV components.

EXAMPLES

Next, the present invention will be explained in more detail based on specific examples, but is not limited thereto.

First, raw material metals of a sintered magnet were prepared and used to manufacture raw material alloys respectively by a strip casting method so that compositions of sintered magnets of Sample No. 1 to Sample No. 22, which are examples of the present invention, and Sample No. 23 to Sample No. 28, which are comparative examples, shown in Table 1 below were obtained. The raw material alloys were manufactured by a strip casting method, and a cooling rate at the time of solidification of a molten metal was 2500° C./second in Sample No. 1 to Sample No. 14 and Sample No. 19 to Sample No. 26. In Sample No. 15, a cooling rate at the time of solidification was 11000° C./second. In Sample No. 16, a cooling rate at the time of solidification was 6500° C./second. In Sample No. 17, a cooling rate at the time of solidification was 900° C./second. In Sample No. 18, a cooling rate at the time of solidification was 500° C./second. In Sample No. 27, a cooling rate at the time of solidification was 200° C./second. In Sample No. 28, a cooling rate at the time of solidification was 16000° C./second. Incidentally, contents of each element shown in Table 1 were measured by fluorescent X-ray analysis in terms of T, R, Cu, and M, and by ICP emission spectroscopic analysis in terms of B. The content of O was measured by an inert gas fusion—non-dispersive infrared absorption method, the content of C was measured by a combustion in oxygen stream-infrared absorption method, and the content of N was measured by an inert gas fusion—thermal conductivity method. Composition ratios of [O]/([C]+[N]) and [M]/[C] of the sintered body were calculated by obtaining atomic numbers of each element based on the contents obtained by the methods.

Next, a hydrogen storage pulverization performing dehydrogenation for 1 hour at 600° C. in an Ar gas atmosphere after hydrogen storing in the raw material alloys was carried out. Thereafter, obtained pulverized objects were cooled to a room temperature in the Ar gas atmosphere.

After adding a pulverization aid to the pulverized objects obtained and mixing them, a fine pulverization was carried out using a jet mill to obtain raw material powders having an average grain size of 3 to 4 μm.

The obtained raw material powders were pressed in a low oxygen atmosphere (an atmosphere having an oxygen concentration of 100 ppm or less) with conditions of an orientation magnetic field of 1200 kA/m and a pressing pressure of 120 MPa, and green compacts were obtained.

Thereafter, the green compacts were sintered for 4 hours at a sintering temperature of 1010 to 1050° C. in a vacuum, and then rapidly cooled to obtain sintered bodies. The obtained sintered bodies were subjected to a two-step heat treatment at 900° C. and 500° C. in an Ar gas atmosphere. In the first heat treatment at 900° C. (Aging 1), all samples were held for 1 hour, cooled from 900° C. to 200° C. at a cooling rate of 50° C./minute after the first heat treatment, and gradually cooled to a room temperature. In the second heat treatment at 500° C. (Aging 2), the sintered bodies were cooled with changed holding times and cooling rates from 500° C. to 200° C. in a decreasing temperature process of the heat treatment, and then gradually cooled to a room temperature, whereby a plurality of samples having different Ga, C, and B concentration distributions in the main phase grain was prepared. Incidentally, Sample No. 24 was not subjected to the heat treatment of Aging 2, but was subjected to only the heat treatment of Aging 1.

Each sample (Sample No. 1 to Sample No. 28) obtained in the above-mentioned manner was measured in terms of magnetic properties. Specifically, residual magnetic flux density (Br) and coercivity (HcJ) were measured respectively using a B-H tracer. Then, thermal demagnetization factor was measured. Table 1 shows these results overall. Next, Sample No. 1 to Sample No. 28 subjected to measurement of magnetic properties were evaluated in terms of Ga, C, and B concentration distributions in the main phase grain by a three-dimensional atom probe microscope. This evaluation was conducted by cutting out 10 parts or more of needle-like specimens for the three-dimensional atom probe measurement with respect to each sample. Before cutting out the needle-like specimens for the three-dimensional atom probe measurement, an electron microscope image of a polished cross section of each sample was obtained. At this time, a visual field was determined so that about 100 main phase grains can be observed in the electron microscope image. Incidentally, this visual field had a size of about 40 μm×50 μm. Main phase grains having a grain size that is larger than an average grain size of the main phase grains in the obtained electron microscope image were selected. Then, the selected main phase grains were sampled in such a manner that the needle-like specimens were cut out by determining a sample cut-out part 5 including a central area of the main phase grain as shown in FIG. 1. The measurement by the three-dimensional atom probe microscope was carried out continuously from near a main phase grain edge part toward an inner part of the grain in 500 nm or more. That is, the respective needle-like specimens had a length of 500 nm or more.

First, the main phase grain edge part was determined. The main phase grain edge part was determined from a graph made in such a manner that a variation of Cu atom concentration near a boundary between the main phase grain 1 and the grain boundary phase 2 was measured at intervals of 2 nm (divisional measurement with a rectangular parallelepiped of 50 nm×50 nm×2 nm as a unit volume) using a three-dimensionally constituted image obtained in the measurement by the three-dimensional atom probe microscope.

Then, the respective needle-like specimens were divided into cubes of 50 nm×50 nm×50 nm as a unit volume on a line from the main phase grain edge part toward the inner part of the grain, and average Ga, C, and B atom concentrations were calculated in each divided region. Distributions of Ga, C, and B atom concentrations were evaluated by graphing the average Ga, C, and B atom concentrations of the divided regions with respect to a distance between a center point and the main phase grain edge part of the divided region.

Incidentally, attention was paid so that no heterogenous phase that is different from a main phase in the main phase grains was contained at the time of cutting out the needle-like specimens for the three-dimensional atom probe microscope measurement, and only data of an $R_2T_{14}B$ type compound phase of the main phase grain was adopted at the time of division into the unit volumes from the three-dimensionally constituted image.

Ga concentrations in the main phase grain were evaluated. In the present description, containing Ga in the main phase grain means a case where 0.01 atom % or more of Ga was detected in the main phase grain in 100 nm or more by the three-dimensional atom probe microscope measurement.

C concentrations in the main phase grain were evaluated. In the present description, containing C in the main phase grain means a case where 0.05 atom % or more of C was detected in the main phase grain in 100 nm or more by the three-dimensional atom probe microscope measurement.

The Ga concentration distribution was evaluated in terms of items mentioned below. First, a concentration ratio A ($A=\alpha Ga/\beta Ga$) of a highest concentration of Ga ($\alpha Ga$) to a lowest concentration of Ga ($\beta Ga$) was calculated, and whether $A \geq 1.20$ was satisfied and whether $A \geq 1.50$ was satisfied were evaluated. Next, whether a position of a lowest concentration of Ga ($\beta Ga$) was present within 100 nm from a main phase grain edge part toward an inner part of the grain was evaluated. Then, both whether the Ga concentration had an increasing gradient from the main phase grain edge part toward the inner part of the grain and whether a region with the increasing gradient had a length of 100 nm or more were evaluated. Finally, both whether the Ga concentration had an increasing gradient from the main phase grain edge part toward the inner part of the grain and whether a region whose absolute value of the increasing gradient was 0.05 atom %/μm or more had a length of 100 nm or more were evaluated.

The C concentration distribution was evaluated in terms of items mentioned below. First, a concentration ratio A1 ($A1=\alpha C/\beta C$) of a highest concentration of C ($\alpha C$) to a lowest concentration of C ($\beta C$) was calculated, and whether $A1 \geq 1.50$ was satisfied and whether $A1 \geq 2.00$ was satisfied were evaluated. Next, whether a position of a lowest concentration of C ($\beta C$) was present within 100 nm from a main phase grain edge part toward an inner part of the grain was evaluated. Then, both whether the C concentration had an increasing gradient from the main phase grain edge part toward the inner part of the grain and whether a region with the increasing gradient had a length of 100 nm or more were evaluated. Finally, both whether the C concentration had an increasing gradient from the main phase grain edge part toward the inner part of the grain and whether a region whose absolute value of the increasing gradient was 0.00010 atom %/nm or more had a length of 100 nm or more were evaluated.

The B concentration distribution was evaluated in terms of items mentioned below. First, a concentration ratio A2 ($A2=\alpha B/\beta B$) of a highest concentration of B ($\alpha B$) to a lowest concentration of B ($\beta B$) was calculated, and whether $A2 \geq 1.05$ was satisfied and whether $A2 \geq 1.08$ was satisfied were evaluated. Next, whether a position showing a highest concentration of B ($\alpha B$) was present within 100 nm from a main phase grain edge part toward an inner part of the grain was evaluated. Then, both whether the B concentration had a decreasing gradient from the main phase grain edge part toward the inner part of the grain and whether a region with the decreasing gradient had a length of 100 nm or more were evaluated. Finally, both whether the B concentration had a decreasing gradient from the main phase grain edge part toward the inner part of the grain and whether a region whose absolute value of the decreasing gradient was 0.0005 atom %/nm or more had a length of 100 nm or more were evaluated.

Table 1 and Table 2 overall show evaluation results of element concentration of Sample No. 1 to Sample No. 22, which are examples of the present invention, and Sample No. 23 to Sample No. 28, which are comparative examples. In the evaluation results of Ga, C, and B concentration distributions and the evaluation results of Ga and C concentration of Table 1 and Table 2, each sample was subjected to measurement evaluations at 10 points, and a frequency to which the measurement points corresponded is represented as the number of corresponding points/the number of measurement parts with respect to each evaluation item.

Table 1 also shows cooling rates of the second heating treatment (Aging 2). Furthermore, Table 3 shows calculated values of [O]/([C]+[N]) and [M]/[C] of each sample, where [C], [O], [N], and [M] are respectively the number of atoms of C, O, N, and M elements contained in the sintered body. The amounts of oxygen and nitrogen contained in the rare earth magnet controlled atmospheres from the pulverization step to the heat treatment step, and were adjusted to the ranges of Table 1 particularly by increasing or decreasing the amounts of oxygen and nitrogen contained in the atmosphere of the pulverization step. The amount of carbon contained in the rare earth magnet was adjusted to the ranges of Table 1 by increasing or decreasing the amount of the pulverization aid added in the pulverization step.

TABLE 1

| | Sample | Composition of sintered magnet (mass %) | | | | | | | | | | | | | | | | Cooling rate at the time of solidification of molten | Sintering condition |
|---|---|---|---|---|---|---|---|---|---|---|---|---|---|---|---|---|---|---|---|
| | | R | | | | | | M | | | | | | | | | | metal | Temperature |
| | No. | Total | Nd | Pr | Dy | B | Cu | Al | Ga | Si | Ge | Sn | Co | Fe | O | C | N | ° C./sec | ° C. |
| Ex. | Samp. 1 | 35.0 | 27.0 | 8.0 | 0.0 | 0.70 | 0.5 | 0.2 | 1.5 | 0.0 | 0.0 | 0.0 | 0.5 | bal. | 0.12 | 0.12 | 0.05 | 2500 | 1010 |
| | Samp. 2 | 32.0 | 26.0 | 6.0 | 0.0 | 0.87 | 0.1 | 0.2 | 0.5 | 0.0 | 0.0 | 0.0 | 0.5 | bal. | 0.10 | 0.09 | 0.05 | 2500 | 1020 |
| | Samp. 3 | 32.0 | 26.0 | 6.0 | 0.0 | 0.84 | 0.1 | 0.2 | 0.5 | 0.0 | 0.0 | 0.0 | 0.5 | bal. | 0.09 | 0.14 | 0.05 | 2500 | 1020 |
| | Samp. 4 | 32.0 | 26.0 | 6.0 | 0.0 | 0.87 | 0.1 | 0.2 | 0.8 | 0.0 | 0.0 | 0.0 | 0.5 | bal. | 0.09 | 0.10 | 0.04 | 2500 | 1020 |
| | Samp. 5 | 32.0 | 26.0 | 6.0 | 0.0 | 0.87 | 0.1 | 0.2 | 0.5 | 0.0 | 0.0 | 0.0 | 0.5 | bal. | 0.07 | 0.12 | 0.05 | 2500 | 1020 |

TABLE 1-continued

| | | | | | | | | | | | | | | | | | | | |
|---|---|---|---|---|---|---|---|---|---|---|---|---|---|---|---|---|---|---|---|
| | Samp. 6 | 32.0 | 25.0 | 6.0 | 1.0 | 0.87 | 0.1 | 0.2 | 0.5 | 0.0 | 0.0 | 0.0 | 0.5 | bal. | 0.10 | 0.12 | 0.04 | 2500 | 1020 |
| | Samp. 7 | 32.0 | 32.0 | 0.0 | 0.0 | 0.87 | 0.1 | 0.2 | 0.5 | 0.0 | 0.0 | 0.0 | 0.5 | bal. | 0.08 | 0.10 | 0.05 | 2500 | 1020 |
| | Samp. 8 | 32.0 | 32.0 | 0.0 | 0.0 | 0.87 | 0.5 | 0.2 | 0.4 | 0.1 | 0.0 | 0.0 | 0.5 | bal. | 0.09 | 0.11 | 0.06 | 2500 | 1020 |
| | Samp. 9 | 32.0 | 32.0 | 0.0 | 0.0 | 0.87 | 1.2 | 0.2 | 0.3 | 0.0 | 0.1 | 0.1 | 0.5 | bal. | 0.08 | 0.11 | 0.05 | 2500 | 1020 |
| | Samp. 10 | 32.0 | 26.0 | 6.0 | 0.0 | 0.87 | 0.1 | 0.2 | 0.5 | 0.0 | 0.0 | 0.0 | 0.5 | bal. | 0.08 | 0.09 | 0.05 | 2500 | 1020 |
| | Samp. 11 | 32.0 | 26.0 | 6.0 | 0.0 | 0.87 | 0.1 | 0.2 | 0.5 | 0.0 | 0.0 | 0.0 | 0.5 | bal. | 0.09 | 0.09 | 0.05 | 2500 | 1020 |
| | Samp. 12 | 32.0 | 26.0 | 6.0 | 0.0 | 0.87 | 0.1 | 0.2 | 0.5 | 0.0 | 0.0 | 0.0 | 0.5 | bal. | 0.08 | 0.09 | 0.05 | 2500 | 1020 |
| | Samp. 13 | 32.0 | 26.0 | 6.0 | 0.0 | 0.87 | 0.1 | 0.2 | 0.5 | 0.0 | 0.0 | 0.0 | 0.5 | bal. | 0.08 | 0.09 | 0.05 | 2500 | 1020 |
| | Samp. 14 | 31.5 | 31.5 | 0.0 | 0.0 | 0.93 | 0.1 | 0.1 | 0.2 | 0.0 | 0.0 | 0.0 | 0.3 | bal. | 0.08 | 0.06 | 0.05 | 2500 | 1030 |
| | Samp. 15 | 31.5 | 31.5 | 0.0 | 0.0 | 0.93 | 0.1 | 0.1 | 0.2 | 0.0 | 0.0 | 0.0 | 0.3 | bal. | 0.08 | 0.06 | 0.05 | 11000 | 1030 |
| | Samp. 16 | 31.5 | 31.5 | 0.0 | 0.0 | 0.93 | 0.1 | 0.1 | 0.2 | 0.0 | 0.0 | 0.0 | 0.3 | bal. | 0.08 | 0.06 | 0.05 | 6500 | 1030 |
| | Samp. 17 | 31.5 | 31.5 | 0.0 | 0.0 | 0.93 | 0.1 | 0.1 | 0.2 | 0.0 | 0.0 | 0.0 | 0.3 | bal. | 0.08 | 0.06 | 0.05 | 900 | 1030 |
| | Samp. 18 | 31.5 | 31.5 | 0.0 | 0.0 | 0.93 | 0.1 | 0.1 | 0.2 | 0.0 | 0.0 | 0.0 | 0.3 | bal. | 0.09 | 0.06 | 0.05 | 500 | 1030 |
| | Samp. 19 | 32.0 | 26.0 | 6.0 | 0.0 | 0.87 | 0.1 | 0.2 | 0.5 | 0.0 | 0.0 | 0.0 | 0.5 | bal. | 0.08 | 0.09 | 0.05 | 2500 | 1020 |
| | Samp. 20 | 29.5 | 23.5 | 6.0 | 0.0 | 0.96 | 0.1 | 0.2 | 0.2 | 0.0 | 0.0 | 0.0 | 0.3 | bal. | 0.08 | 0.07 | 0.05 | 2500 | 1040 |
| | Samp. 21 | 32.0 | 26.0 | 6.0 | 0.0 | 0.98 | 0.1 | 0.2 | 0.5 | 0.0 | 0.0 | 0.0 | 0.5 | bal. | 0.09 | 0.09 | 0.05 | 2500 | 1020 |
| | Samp. 22 | 29.5 | 23.5 | 6.0 | 0.0 | 0.96 | 0.1 | 0.0 | 0.1 | 0.0 | 0.0 | 0.0 | 0.3 | bal. | 0.09 | 0.07 | 0.05 | 2500 | 1040 |
| Comp. | Samp. 23 | 32.0 | 26.0 | 6.0 | 0.0 | 0.87 | 0.1 | 0.2 | 0.5 | 0.0 | 0.0 | 0.0 | 0.5 | bal. | 0.12 | 0.07 | 0.04 | 2500 | 1020 |
| Ex. | Samp. 24 | 32.0 | 26.0 | 6.0 | 0.0 | 0.87 | 0.1 | 0.2 | 0.5 | 0.0 | 0.0 | 0.0 | 0.5 | bal. | 0.10 | 0.05 | 0.04 | 2500 | 1020 |
| | Samp. 25 | 32.0 | 25.0 | 6.0 | 1.0 | 1.00 | 0.1 | 0.2 | 0.0 | 0.0 | 0.0 | 0.0 | 0.5 | bal. | 0.13 | 0.08 | 0.04 | 2500 | 1050 |
| | Samp. 26 | 32.0 | 26.0 | 6.0 | 0.0 | 0.60 | 0.1 | 0.2 | 0.5 | 0.0 | 0.0 | 0.0 | 0.5 | bal. | 0.15 | 0.08 | 0.04 | 2500 | 1030 |
| | Samp. 27 | 31.5 | 31.5 | 0.0 | 0.0 | 0.93 | 0.1 | 0.1 | 0.2 | 0.0 | 0.0 | 0.0 | 0.3 | bal. | 0.12 | 0.07 | 0.04 | 200 | 1030 |
| | Samp. 28 | 31.5 | 31.5 | 0.0 | 0.0 | 0.93 | 0.1 | 0.1 | 0.2 | 0.0 | 0.0 | 0.0 | 0.3 | bal. | 0.12 | 0.07 | 0.04 | 16000 | 1030 |

| | | Conditions of Aging 2 | | Magnetic properties | | | Frequency of measured parts | Frequency of measured parts |
|---|---|---|---|---|---|---|---|---|
| | Sample No. | Holding time hr | Cooling rate ° C./min | Residual magnetic flux density (Br) kG | Coercivity (HcJ) kOe | Thermal demagnetization factor % | where 0.01 atom % or more of Ga was detected in main phase grain in 100 nm or more | where 0.05 atom % or more of C was detected in main phase grain in 100 nm or more |
| Ex. | Samp. 1 | 0.7 | 100 | 12.3 | 22.9 | −0.2 | 10/10 | 10/10 |
| | Samp. 2 | 1.0 | 100 | 13.7 | 21.5 | −0.3 | 10/10 | 10/10 |
| | Samp. 3 | 1.0 | 100 | 13.5 | 21.5 | −0.4 | 10/10 | 10/10 |
| | Samp. 4 | 1.0 | 100 | 13.3 | 21.3 | −0.3 | 10/10 | 10/10 |
| | Samp. 5 | 1.0 | 100 | 13.7 | 20.7 | −0.3 | 10/10 | 10/10 |
| | Samp. 6 | 1.0 | 100 | 13.5 | 21.9 | −0.5 | 10/10 | 10/10 |
| | Samp. 7 | 1.0 | 100 | 13.9 | 19.9 | −0.5 | 10/10 | 10/10 |
| | Samp. 8 | 1.0 | 100 | 13.6 | 19.8 | −0.5 | 10/10 | 10/10 |
| | Samp. 9 | 1.0 | 100 | 13.4 | 19.9 | −0.5 | 10/10 | 10/10 |
| | Samp. 10 | 2.0 | 150 | 13.5 | 18.1 | −0.8 | 10/10 | 10/10 |
| | Samp. 11 | 2.0 | 125 | 13.6 | 18.0 | −0.9 | 10/10 | 10/10 |
| | Samp. 12 | 2.0 | 100 | 13.6 | 17.8 | −0.9 | 10/10 | 10/10 |
| | Samp. 13 | 2.0 | 75 | 13.5 | 17.8 | −0.9 | 10/10 | 10/10 |
| | Samp. 14 | 1.0 | 100 | 13.9 | 16.5 | −0.9 | 10/10 | 10/10 |
| | Samp. 15 | 1.0 | 100 | 13.9 | 17.1 | −0.7 | 10/10 | 10/10 |
| | Samp. 16 | 1.0 | 100 | 13.8 | 17.0 | −0.7 | 10/10 | 10/10 |
| | Samp. 17 | 1.0 | 100 | 13.9 | 16.7 | −1.3 | 10/10 | 10/10 |
| | Samp. 18 | 1.0 | 100 | 13.9 | 16.3 | −1.5 | 10/10 | 10/10 |
| | Samp. 19 | 2.0 | 50 | 14.0 | 16.5 | −2.2 | 10/10 | 10/10 |
| | Samp. 20 | 1.5 | 100 | 14.2 | 15.9 | −2.8 | 10/10 | 10/10 |
| | Samp. 21 | 1.5 | 100 | 14.1 | 16.5 | −2.9 | 10/10 | 10/10 |
| | Samp. 22 | 1.5 | 100 | 14.2 | 15.8 | −3.4 | 10/10 | 10/10 |
| Comp. | Samp. 23 | 2.0 | 25 | 14.0 | 16.1 | −4.0 | 10/10 | 10/10 |
| Ex. | Samp. 24 | No Aging 2 | | 14.0 | 12.2 | −4.1 | 10/10 | 10/10 |
| | Samp. 25 | 1.0 | 100 | 13.4 | 17.3 | −4.4 | 0/10 | 0/10 |
| | Samp. 26 | 1.0 | 100 | 12.5 | 13.8 | −3.6 | 4/10 | 4/10 |
| | Samp. 27 | 1.0 | 100 | 13.3 | 15.8 | −4.0 | 1/10 | 1/10 |
| | Samp. 28 | 1.0 | 100 | 13.1 | 14.5 | −3.7 | 7/10 | 7/10 |

TABLE 2

| | | Evaluation results of Ga concentration distribution in main phase grain with $R_2T_{14}B$ type crystal structure | | | | |
|---|---|---|---|---|---|---|
| | | Concentration ratio A (A = αGa/βGa, highest concentration αGa, lowest concentration βGa) | | Frequency of measured parts where position of βGa was present within | Frequency of measured parts having both concentration gradient increasing from main phase grain edge toward inner part of main phase | Frequency of measured parts having region where absolute value of concentration gradient |
| | Sample No. | Frequency of measured parts of A ≥ 1.20 Item G-1 | Frequency of measured parts of A ≥ 1.50 Item G-2 | 100 nm from main phase grain edge toward inner part of main phase grain Item G-3 | grain and region with concentration gradient in 100 nm or more Item G-4 | of Ga was 0.05 atom %/μm or more in 100 nm or more Item G-5 |
| Ex. | Samp. 1 | 10/10 | 10/10 | 10/10 | 10/10 | 9/10 |
| | Samp. 2 | 10/10 | 10/10 | 10/10 | 10/10 | 10/10 |
| | Samp. 3 | 10/10 | 10/10 | 10/10 | 10/10 | 10/10 |
| | Samp. 4 | 10/10 | 10/10 | 10/10 | 9/10 | 9/10 |
| | Samp. 5 | 10/10 | 10/10 | 10/10 | 10/10 | 9/10 |
| | Samp. 6 | 10/10 | 10/10 | 9/10 | 8/10 | 7/10 |
| | Samp. 7 | 10/10 | 10/10 | 10/10 | 9/10 | 8/10 |
| | Samp. 8 | 10/10 | 10/10 | 10/10 | 9/10 | 8/10 |
| | Samp. 9 | 10/10 | 10/10 | 10/10 | 9/10 | 8/10 |
| | Samp. 10 | 10/10 | 9/10 | 9/10 | 9/10 | 8/10 |
| | Samp. 11 | 10/10 | 9/10 | 9/10 | 8/10 | 8/10 |
| | Samp. 12 | 10/10 | 8/10 | 8/10 | 8/10 | 7/10 |
| | Samp. 13 | 9/10 | 7/10 | 7/10 | 6/10 | 5/10 |
| | Samp. 14 | 10/10 | 9/10 | 10/10 | 9/10 | 8/10 |
| | Samp. 15 | 10/10 | 10/10 | 10/10 | 10/10 | 8/10 |
| | Samp. 16 | 10/10 | 10/10 | 10/10 | 10/10 | 9/10 |
| | Samp. 17 | 10/10 | 8/10 | 8/10 | 7/10 | 0/10 |
| | Samp. 18 | 9/10 | 7/10 | 7/10 | 0/10 | 0/10 |
| | Samp. 19 | 9/10 | 6/10 | 0/10 | 0/10 | 0/10 |
| | Samp. 20 | 7/10 | 0/10 | 0/10 | 0/10 | 0/10 |
| | Samp. 21 | 6/10 | 0/10 | 0/10 | 0/10 | 0/10 |
| | Samp. 22 | 5/10 | 0/10 | 0/10 | 0/10 | 0/10 |
| | Samp. 23 | 0/10 | 0/10 | 0/10 | 0/10 | 0/10 |
| Comp. | Samp. 24 | 0/10 | 0/10 | 0/10 | 0/10 | 0/10 |
| Ex. | Samp. 25 | 0/10 | 0/10 | 0/10 | 0/10 | 0/10 |
| | Samp. 26 | 0/10 | 0/10 | 0/10 | 0/10 | 0/10 |
| | Samp. 27 | 0/10 | 0/10 | 0/10 | 0/10 | 0/10 |
| | Samp. 28 | 0/10 | 0/10 | 0/10 | 0/10 | 0/10 |

| | | Evaluation results of C concentration distribution in main phase grain with $R_2T_{14}B$ type crystal structure | | | | |
|---|---|---|---|---|---|---|
| | | Concentration ratio A1 (A1 = αC/βC, highest concentration αC, lowest concentration βC) | | Frequency of measured parts where position of βC was present within | Frequency of measured parts having both concentration gradient increasing from main phase grain edge toward inner part of main phase | Frequency of measured parts having region where absolute value of concentration gradient |
| | Sample No. | Frequency of measured parts of A1 ≥ 1.50 Item C-1 | Frequency of measured parts of A1 ≥ 2.00 Item C-2 | 100 nm from main phase grain edge toward inner part of main phase grain Item C-3 | grain and region with concentration gradient in 100 nm or more Item C-4 | of C was 0.00010 atom %/nm or more in 100 nm or more Item C-5 |
| Ex. | Samp. 1 | 10/10 | 10/10 | 10/10 | 10/10 | 9/10 |
| | Samp. 2 | 10/10 | 10/10 | 10/10 | 10/10 | 10/10 |
| | Samp. 3 | 10/10 | 10/10 | 10/10 | 10/10 | 10/10 |
| | Samp. 4 | 10/10 | 10/10 | 10/10 | 9/10 | 9/10 |
| | Samp. 5 | 10/10 | 10/10 | 10/10 | 10/10 | 9/10 |
| | Samp. 6 | 10/10 | 10/10 | 9/10 | 8/10 | 7/10 |
| | Samp. 7 | 10/10 | 10/10 | 10/10 | 9/10 | 8/10 |
| | Samp. 8 | 10/10 | 10/10 | 10/10 | 9/10 | 8/10 |
| | Samp. 9 | 10/10 | 10/10 | 10/10 | 9/10 | 8/10 |
| | Samp. 10 | 10/10 | 9/10 | 9/10 | 9/10 | 8/10 |
| | Samp. 11 | 10/10 | 9/10 | 9/10 | 8/10 | 8/10 |
| | Samp. 12 | 10/10 | 8/10 | 8/10 | 8/10 | 7/10 |
| | Samp. 13 | 9/10 | 7/10 | 7/10 | 6/10 | 5/10 |
| | Samp. 14 | 10/10 | 9/10 | 10/10 | 9/10 | 8/10 |
| | Samp. 15 | 10/10 | 10/10 | 10/10 | 10/10 | 8/10 |
| | Samp. 16 | 10/10 | 10/10 | 10/10 | 10/10 | 9/10 |
| | Samp. 17 | 10/10 | 8/10 | 8/10 | 7/10 | 0/10 |
| | Samp. 18 | 9/10 | 7/10 | 7/10 | 0/10 | 0/10 |
| | Samp. 19 | 9/10 | 6/10 | 0/10 | 0/10 | 0/10 |
| | Samp. 20 | 7/10 | 0/10 | 0/10 | 0/10 | 0/10 |
| | Samp. 21 | 6/10 | 0/10 | 0/10 | 0/10 | 0/10 |

TABLE 2-continued

| | | | | | | |
|---|---|---|---|---|---|---|
| | Samp. 22 | 5/10 | 0/10 | 0/10 | 0/10 | 0/10 |
| | Samp. 23 | 0/10 | 0/10 | 0/10 | 0/10 | 0/10 |
| Comp. | Samp. 24 | 0/10 | 0/10 | 0/10 | 0/10 | 0/10 |
| Ex. | Samp. 25 | 0/10 | 0/10 | 0/10 | 0/10 | 0/10 |
| | Samp. 26 | 0/10 | 0/10 | 0/10 | 0/10 | 0/10 |
| | Samp. 27 | 0/10 | 0/10 | 0/10 | 0/10 | 0/10 |
| | Samp. 28 | 0/10 | 0/10 | 0/10 | 0/10 | 0/10 |

| | | Evaluation results of B concentration distribution in main phase grain with $R_2T_{14}B$ type crystal structure | | | | |
|---|---|---|---|---|---|---|
| | | Concentration ratio A2 (A2 = αB/βB, highest concentration αB, lowest concentration βB) | | Frequency of measured parts where position of αB was present within | Frequency of measured parts having both concentration gradient decreasing from main phase grain edge toward inner part of main phase | Frequency of measured parts having region where absolute value of concentration gradient |
| | Sample No. | Frequency of measured parts of A2 ≥ 1.05 Item B-1 | Frequency of measured parts of A2 ≥ 1.08 Item B-2 | 100 nm from main phase grain edge toward inner part of main phase grain Item B-3 | grain and region with concentration gradient in 100 nm or more Item B-4 | of B was 0.0005 atom %/nm or more in 100 nm or more Item B-5 |
| Ex. | Samp. 1 | 10/10 | 10/10 | 10/10 | 10/10 | 9/10 |
| | Samp. 2 | 10/10 | 10/10 | 10/10 | 10/10 | 10/10 |
| | Samp. 3 | 10/10 | 10/10 | 10/10 | 10/10 | 10/10 |
| | Samp. 4 | 10/10 | 10/10 | 10/10 | 9/10 | 9/10 |
| | Samp. 5 | 10/10 | 10/10 | 10/10 | 10/10 | 9/10 |
| | Samp. 6 | 10/10 | 10/10 | 9/10 | 8/10 | 7/10 |
| | Samp. 7 | 10/10 | 10/10 | 10/10 | 9/10 | 8/10 |
| | Samp. 8 | 10/10 | 10/10 | 10/10 | 9/10 | 8/10 |
| | Samp. 9 | 10/10 | 10/10 | 10/10 | 9/10 | 8/10 |
| | Samp. 10 | 10/10 | 9/10 | 9/10 | 9/10 | 8/10 |
| | Samp. 11 | 10/10 | 9/10 | 9/10 | 8/10 | 8/10 |
| | Samp. 12 | 10/10 | 8/10 | 8/10 | 8/10 | 7/10 |
| | Samp. 13 | 9/10 | 7/10 | 7/10 | 6/10 | 5/10 |
| | Samp. 14 | 10/10 | 9/10 | 10/10 | 9/10 | 8/10 |
| | Samp. 15 | 10/10 | 10/10 | 10/10 | 10/10 | 8/10 |
| | Samp. 16 | 10/10 | 10/10 | 10/10 | 10/10 | 9/10 |
| | Samp. 17 | 10/10 | 8/10 | 8/10 | 7/10 | 0/10 |
| | Samp. 18 | 9/10 | 7/10 | 7/10 | 0/10 | 0/10 |
| | Samp. 19 | 9/10 | 6/10 | 0/10 | 0/10 | 0/10 |
| | Samp. 20 | 7/10 | 0/10 | 0/10 | 0/10 | 0/10 |
| | Samp. 21 | 6/10 | 0/10 | 0/10 | 0/10 | 0/10 |
| | Samp. 22 | 5/10 | 0/10 | 0/10 | 0/10 | 0/10 |
| | Samp. 23 | 0/10 | 0/10 | 0/10 | 0/10 | 0/10 |
| Comp. | Samp. 24 | 0/10 | 0/10 | 0/10 | 0/10 | 0/10 |
| Ex. | Samp. 25 | 0/10 | 0/10 | 0/10 | 0/10 | 0/10 |
| | Samp. 26 | 0/10 | 0/10 | 0/10 | 0/10 | 0/10 |
| | Samp. 27 | 0/10 | 0/10 | 0/10 | 0/10 | 0/10 |
| | Samp. 28 | 0/10 | 0/10 | 0/10 | 0/10 | 0/10 |

TABLE 3

| | Sample | Ratios of number of atoms | |
|---|---|---|---|
| | No. | [O]/([C] + [N]) | [M]/[C] |
| Ex. | Samp. 1 | 0.56 | 2.92 |
| | Samp. 2 | 0.57 | 1.96 |
| | Samp. 3 | 0.37 | 1.26 |
| | Samp. 4 | 0.51 | 2.29 |
| | Samp. 5 | 0.32 | 1.47 |
| | Samp. 6 | 0.49 | 1.47 |
| | Samp. 7 | 0.42 | 1.76 |
| | Samp. 8 | 0.42 | 1.84 |
| | Samp. 9 | 0.39 | 1.53 |
| | Samp. 10 | 0.45 | 1.96 |
| | Samp. 11 | 0.51 | 1.96 |
| | Samp. 12 | 0.45 | 1.96 |
| | Samp. 13 | 0.45 | 1.96 |
| | Samp. 14 | 0.59 | 1.33 |
| | Samp. 15 | 0.59 | 1.33 |
| | Samp. 16 | 0.59 | 1.33 |
| | Samp. 17 | 0.59 | 1.33 |
| | Samp. 18 | 0.66 | 1.33 |
| | Samp. 19 | 0.45 | 1.96 |

TABLE 3-continued

| | Sample | Ratios of number of atoms | |
|---|---|---|---|
| | No. | [O]/([C] + [N]) | [M]/[C] |
| | Samp. 20 | 0.53 | 1.78 |
| | Samp. 21 | 0.51 | 1.96 |
| | Samp. 22 | 0.60 | 0.25 |
| Comp. | Samp. 23 | 0.87 | 2.52 |
| Ex. | Samp. 24 | 0.89 | 3.53 |
| | Samp. 25 | 0.86 | 1.12 |
| | Samp. 26 | 0.99 | 2.21 |
| | Samp. 27 | 0.87 | 1.14 |
| | Samp. 28 | 0.87 | 1.14 |

According to Table 1 and Table 2, when αGa and βGa are respectively a highest concentration of Ga and a lowest concentration of Ga in one main phase grain having an $R_2T_{14}B$ type crystal structure, Sample No. 1 to Sample No. 22, which are examples of the present invention, contained main phase grains having a Ga concentration difference where a concentration ratio A of αGa to βGa (A=αGa/βGa) was 1.20 or more, but no main phase grains having a Ga concentration difference where the concentration ratio A1 was 1.20 or more were observed in Sample No. 23 to Sample No. 28, which are comparative examples. In the sample group of Sample No. 1 to Sample No. 22, it is understood that absolute values of thermal demagnetization factor were able to be controlled to 3.5% or less, and that the rare earth magnets also suitable for use in high temperature environment were obtained. Furthermore, it is understood from the results of Sample No. 1 to Sample No. 19 that absolute values of thermal demagnetization factor were controlled to 2.5% or less by containing main phase grains having a Ga concentration difference where the concentration ratio A of αGa to βGa (A=αGa/βGa) was 1.50 or more.

According to Table 1 and Table 2, it is further understood that absolute values of thermal demagnetization factor were controlled to 1.5% or less in Sample No. 1 to Sample No. 18, which contained a main phase grain having both a Ga concentration difference where the concentration ratio A was 1.20 or more and a position of the lowest concentration of Ga (βGa) present within 100 nm from a main phase grain edge part toward an inner part of the grain. This is conceivably because a part whose magnetic properties had been changed from those of the inner part of the main phase grain (a part having a high Ga concentration) was formed continuously from the inner part of the main phase grain (a part having a high Ga concentration) to the outer edge part of the main phase grain (a part having a low Ga concentration), and as a result, an anisotropy magnetic field gap was formed to cover the grain and it became possible to greatly restrain thermal demagnetization factor.

Absolute values of thermal demagnetization factor can be controlled to 1.3% or less in Sample No. 1 to Sample No. 17, which contained a main phase grain where a Ga concentration distribution of the main phase grain had an increasing gradient from the main phase grain edge part toward the inner part of the grain and where a region with the increasing gradient had a length of 100 nm or more. Furthermore, absolute values of thermal demagnetization factor were controlled to 1.0% or less in Sample No. 1 to Sample No. 16, which contained a main phase grain where a Ga concentration distribution of the main phase grain had an increasing gradient from the main phase grain edge part toward the inner part of the grain and where a region whose absolute value of the Ga concentration gradient was 0.05 atom %/μm or more had a length of 100 nm or more. It is conceivable that when such a steep and wide part having changed magnetic properties is formed near the surface of the main phase grain, it becomes possible to prevent generation and motion of magnetic domain wall near the surface of the main phase grain and control thermal demagnetization factor.

According to Table 1 and Table 2, when αC and βC are respectively a highest concentration of C and a lowest concentration of C in one of main phase grains having an $R_2T_{14}B$ type crystal structure, Sample No. 1 to Sample No. 22, which are examples of the present invention, contained main phase grains having a C concentration difference where a concentration ratio A1 of αC to βC (A1=αC/βC) was 1.50 or more. In the sample group of Sample No. 1 to Sample No. 22, it is understood that absolute values of thermal demagnetization factor were able to be controlled to 3.5% or less, and that the rare earth magnets also suitable for use in high temperature environment were obtained. Furthermore, it is understood from the results of Sample No. 1 to Sample No. 19 that absolute values of thermal demagnetization factor were controlled to 2.5% or less by containing a main phase grain having a C concentration difference where the concentration ratio A1 of αC to βC (A1=αC/βC) was 2.00 or more.

According to Table 1 and Table 2, it is further understood that absolute values of thermal demagnetization factor were controlled to 1.5% or less in Sample No. 1 to Sample No. 18, which contained a main phase grain having both a C concentration difference where the concentration ratio A1 was 1.50 or more and a position showing the lowest concentration of C (βC) present within 100 nm from a main phase grain edge part toward an inner part of the grain.

Absolute values of thermal demagnetization factor can be controlled to 1.3% or less in Sample No. 1 to Sample No. 17, which contained a main phase grain where a C concentration distribution of the main phase grain had an increasing gradient from the main phase grain edge part toward the inner part of the grain and where a region with the increasing gradient had a length of 100 nm or more. Furthermore, absolute values of thermal demagnetization factor were controlled to 1.0% or less in Sample No. 1 to Sample No. 16, which contained a main phase grain where a C concentration distribution of the main phase grain had an increasing gradient from the main phase grain edge part toward the inner part of the grain and where a region whose absolute value of the C concentration gradient was 0.00010 atom %/nm or more had a length of 100 nm or more.

According to Table 1 and Table 2, when αB and βB are respectively a highest concentration of B and a lowest concentration of B in one of main phase grains having an $R_2T_{14}B$ type crystal structure, Sample No. 1 to Sample No. 22, which are examples of the present invention, contained main phase grains having a B concentration difference where a concentration ratio A2 of αB to βB (A2=αB/βB) was 1.05 or more. In the sample group of Sample No. 1 to Sample No. 22, it is understood that absolute values of thermal demagnetization factor were able to be controlled to 3.5% or less, and that the rare earth magnets also suitable for use in high temperature environment were obtained. Furthermore, it is understood from the results of Sample No. 1 to Sample No. 19 that absolute values of thermal demagnetization factor were controlled to 2.5% or less by containing a main phase grain having a B concentration difference where the concentration ratio A2 of αB to βB (A2=αB/βB) was 1.08 or more.

According to Table 1 and Table 2, it is further understood that absolute values of thermal demagnetization factor were controlled to 1.5% or less in Sample No. 1 to Sample No. 18, which contained a main phase grain having both a B concentration difference where the concentration ratio A2 was 1.05 or more and a position showing the highest concentration of B (αB) present within 100 nm from a main phase grain edge part toward an inner part of the grain.

Absolute values of thermal demagnetization factor can be controlled to 1.3% or less in Sample No. 1 to Sample No. 17, which contained a main phase grain where a B concentration distribution of the main phase grain had a decreasing gradient from the main phase grain edge part toward the inner part of the grain and where a region with the decreasing gradient had a length of 100 nm or more. Furthermore, absolute values of thermal demagnetization factor were controlled to 1.0% or less in Sample No. 1 to Sample No. 16, which contained a main phase grain where a B concentration distribution of the main phase grain had a decreasing gradient from the main phase grain edge part toward the inner part of the grain and where a region whose absolute value of the B concentration gradient was 0.0005 atom %/nm or more had a length of 100 nm or more.

Figure 2:
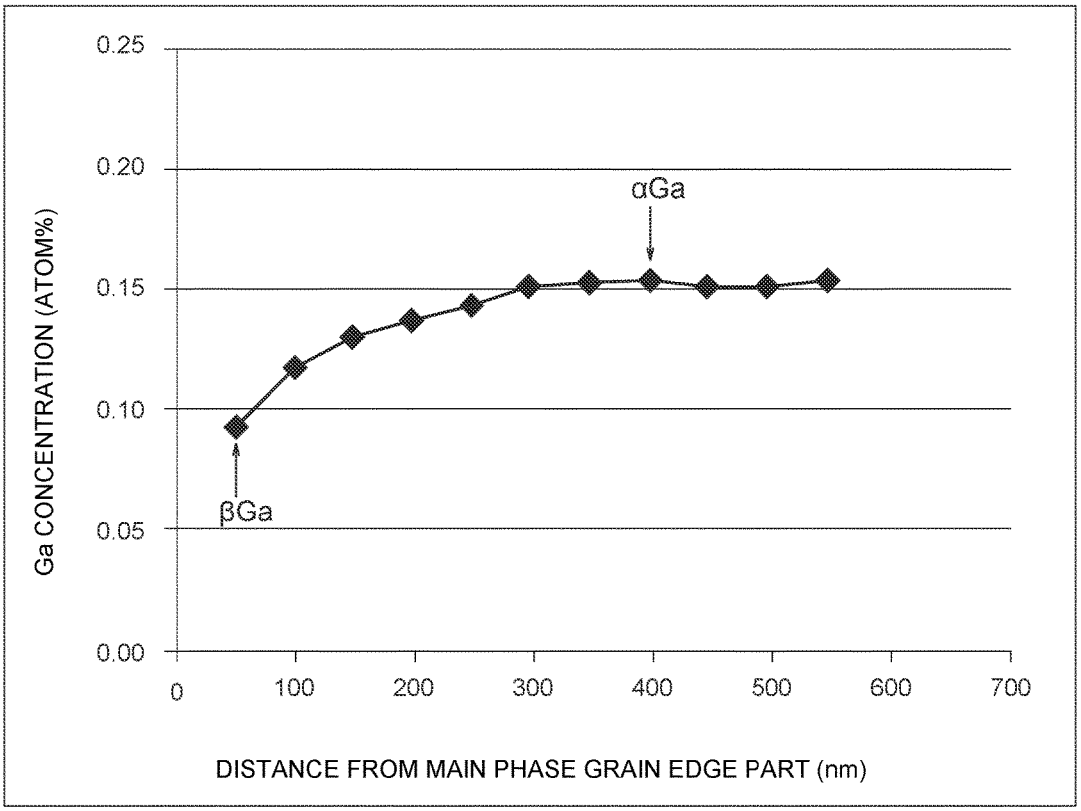
FIG. 2 is a figure showing a concentration distribution of Ga in Example of the present invention.
Figure 3:
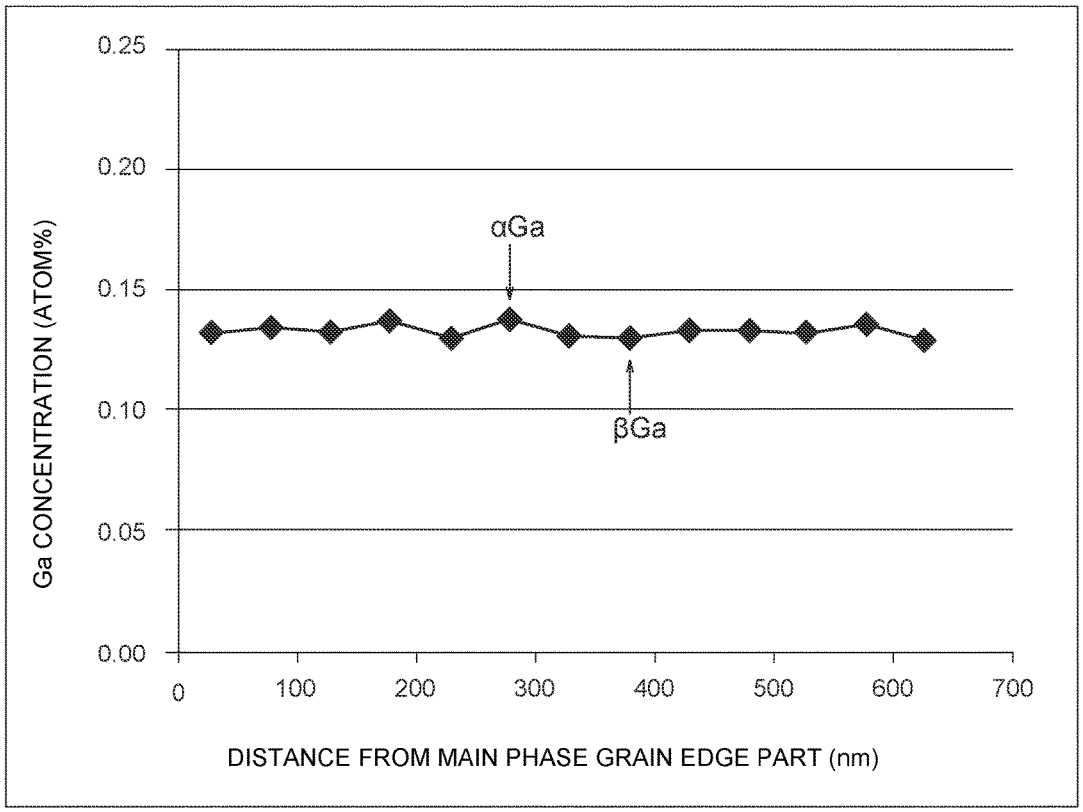
FIG. 3 is a figure showing a concentration distribution of Ga in Comparative Example of the present invention.

Next, the Ga concentration distribution in the main phase grain of the rare earth magnet according to the present example will be explained in more detail. FIG. 2 shows a measurement example of a Ga concentration distribution measured linearly by a three-dimensional atom probe microscope from the edge part of the main phase grain formed in Sample No. 2 toward the inner part of the grain. In FIG. 2 and FIG. 3, average Ga atom concentrations of the divided regions are graphed with respect to a distance between a central point and a main phase grain edge part of the divided region. From the results of element analysis by the three-dimensional atom probe microscope, it is understood that Sample No. 2 contains a main phase grain whose concentration ratio A is 1.69, which is a value that is larger than 1.50. It is further understood that a position showing a lowest concentration of Ga (βGa) in a measurement range is present within 100 nm from a main phase grain edge part toward an inner part of the grain, Sample No. 2 has a concentration gradient increasing from a main phase grain edge part toward an inner part of the main phase grain, and Sample No. 2 has a region whose absolute value of the Ga concentration gradient is 0.05 atom %/μm or more in 100 nm or more.

FIG. 3 shows a measurement example of a Ga concentration distribution measured linearly by a three-dimensional atom probe microscope from the edge part of the main phase grain formed in Sample No. 23, which is a comparative example of prior arts, toward the inner part of the grain. From the results of element analysis by the three-dimensional atom probe microscope, it is understood that Sample No. 23 has a concentration ratio A of 1.06, which is a smaller value than 1.20, and has no microstructure of the present invention. Sample No. 24 to Sample No. 28, which are comparative examples, had similar Ga concentration distributions. It is conceivable that this shows thermal demagnetization was not restrained.

As shown in Table 3, in Sample No. 1 to Sample No. 22, which are examples of the present invention, the main phase grain has a Ga concentration difference, and the number of atoms of O, C, and N contained in the sintered magnet satisfies the following specific relation. That is, a relation of $[O]/([C]+[N])<0.85$ is satisfied, where [O], [C], and [N] are respectively the number of atoms of O, C, and N. In case of $[O]/([C]+[N])<0.85$, it was possible to effectively improve coercivity (HcJ) and effectively restrain thermal demagnetization factor.

According to Table 3, the following specific relation is satisfied in the number of atoms of C and M contained in the sintered magnets of Sample No. 2, Sample No. 3, and Sample No. 5 to Sample No. 21. That is, a relation of $1.20<[M]/[C]<2.00$ is satisfied, where [C] and [M] are respectively the number of atoms of C and M. In case of $1.20<[M]/[C]<2.00$, both high residual magnetic flux density and restraint of thermal demagnetization factor can be obtained.

Next, Sample No. 32 was prepared in such a manner that the main component had a composition of 25 wt % Nd-7Pr-1.5 Dy-0.93 B-0.20 Al-2 Co-0.2 Cu-0.17 Ga-0.08 O-0.08 C-0.005 N, and that the amount of carbon contained in the raw material alloy was 100 ppm. Furthermore, Sample No. 30, Sample No. 31, Sample No. 33, and Sample No. 34 were prepared by changing the amount of carbon contained in the raw material alloy. Table 4 shows the results.

TABLE 4

| | | Magnetic properties | | | | | | | |
|---|---|---|---|---|---|---|---|---|---|
| | Amount of carbon in raw material alloy ppm | Residual magnetic flux density (Br) kG | Coercivity (HcJ) kOe | Thermal demagnetization factor % | Frequency of measured parts where Ga was detected in main phase grain | Frequency of measured parts where C was detected in main phase grain | Item G-1 | Item G-2 | Item G-3 |
| Samp. 30 | 50 | 13.7 | 16.1 | −2.9 | 7/10 | 7/10 | 5/10 | 0/10 | 0/10 |
| Samp. 31 | 80 | 13.7 | 16.5 | −1.1 | 10/10 | 10/10 | 9/10 | 8/10 | 8/10 |
| Samp. 32 | 100 | 13.7 | 20.3 | −0.5 | 10/10 | 10/10 | 10/10 | 10/10 | 10/10 |
| Samp. 33 | 150 | 13.7 | 20.4 | −0.3 | 10/10 | 10/10 | 10/10 | 10/10 | 10/10 |
| Samp. 34 | 200 | 13.7 | 20.4 | −0.3 | 10/10 | 10/10 | 10/10 | 10/10 | 10/10 |

| | Item G-4 | Item G-5 | Item C-1 | Item C-2 | Item C-3 | Item C-4 | Item C-5 | Item B-1 | Item B-2 | Item B-3 | Item B-4 | Item B-5 |
|---|---|---|---|---|---|---|---|---|---|---|---|---|
| Samp. 30 | 0/10 | 0/10 | 5/10 | 0/10 | 0/10 | 0/10 | 0/10 | 5/10 | 0/10 | 0/10 | 0/10 | 0/10 |
| Samp. 31 | 7/10 | 0/10 | 9/10 | 8/10 | 8/10 | 7/10 | 0/10 | 9/10 | 8/10 | 8/10 | 7/10 | 0/10 |
| Samp. 32 | 10/10 | 9/10 | 10/10 | 10/10 | 10/10 | 10/10 | 9/10 | 10/10 | 10/10 | 10/10 | 10/10 | 9/10 |
| Samp. 33 | 10/10 | 10/10 | 10/10 | 10/10 | 10/10 | 10/10 | 10/10 | 10/10 | 10/10 | 10/10 | 10/10 | 10/10 |
| Samp. 34 | 9/10 | 9/10 | 10/10 | 10/10 | 10/10 | 9/10 | 9/10 | 10/10 | 10/10 | 10/10 | 9/10 | 9/10 |

Table 4 shows that the Ga concentration ratio A and the Ga concentration gradient are easily in favorable ranges when the amount of carbon contained in the raw material alloy is 100 ppm or more.

Next, Sample No. 41 to Sample No. 44 were prepared in the same manner as Sample No. 32 except for changing a temperature rising speed from a room temperature to 300° C. in the sintering step. Table 5 shows the results.

TABLE 5

| | Temperature rising speed in sintering step ° C./min | Magnetic properties: Residual magnetic flux density (Br) kG | Coercivity (HcJ) kOe | Thermal demagnetization factor % | Frequency of measured parts where Ga was detected in main phase grain | Frequency of measured parts where C was detected in main phase grain | Item G-1 | Item G-2 | Item G-3 |
|---|---|---|---|---|---|---|---|---|---|
| Samp. 41 | 1 | 13.7 | 15.8 | −3.8 | 10/10 | 10/10 | 4/10 | 0/10 | 0/10 |
| Samp. 42 | 2 | 13.7 | 16.3 | −1.5 | 10/10 | 10/10 | 9/10 | 7/10 | 6/10 |
| Samp. 32 | 5 | 13.7 | 20.3 | −0.5 | 10/10 | 10/10 | 10/10 | 10/10 | 10/10 |
| Samp. 43 | 8 | 13.7 | 21.2 | −0.4 | 10/10 | 10/10 | 10/10 | 10/10 | 10/10 |
| Samp. 44 | 20 | 13.7 | 21.5 | −0.4 | 10/10 | 10/10 | 10/10 | 10/10 | 10/10 |

| | Item G-4 | Item G-5 | Item C-1 | Item C-2 | Item C-3 | Item C-4 | Item C-5 | Item B-1 | Item B-2 | Item B-3 | Item B-4 | Item B-5 |
|---|---|---|---|---|---|---|---|---|---|---|---|---|
| Samp. 41 | 0/10 | 0/10 | 4/10 | 0/10 | 0/10 | 0/10 | 0/10 | 4/10 | 0/10 | 0/10 | 0/10 | 0/10 |
| Samp. 42 | 0/10 | 0/10 | 9/10 | 7/10 | 6/10 | 0/10 | 0/10 | 9/10 | 7/10 | 6/10 | 0/10 | 0/10 |
| Samp. 32 | 10/10 | 9/10 | 10/10 | 10/10 | 10/10 | 10/10 | 9/10 | 10/10 | 10/10 | 10/10 | 10/10 | 9/10 |
| Samp. 43 | 10/10 | 10/10 | 10/10 | 10/10 | 10/10 | 10/10 | 10/10 | 10/10 | 10/10 | 10/10 | 10/10 | 10/10 |
| Samp. 44 | 9/10 | 9/10 | 10/10 | 10/10 | 10/10 | 9/10 | 9/10 | 10/10 | 10/10 | 10/10 | 9/10 | 9/10 |

Table 5 shows that the Ga concentration ratio A is in a favorable range when a temperature rising rate from a room temperature to 300° C. is 1° C./minute or more, and that the Ga concentration ratio A and the Ga concentration gradient are easily in favorable ranges when a temperature rising rate from a room temperature to 300° C. is 2° C./minute or more. It is also understood that the case where a temperature rising speed from a room temperature to 300° C. is 4° C./minute or more is further favorable.

Next, Sample No. 51 to Sample No. 54 were prepared in the same manner as Sample No. 32 except for changing the amount of oleic amide added as a pulverization aid. Table 6 shows the results.

TABLE 6

| | Oleic amide Mass % | [O]/([C] + [N]) | [M]/[C] | Magnetic properties: Residual magnetic flux density (Br) kG | Coercivity (HcJ) kOe | Thermal demagnetization factor % | Frequency of measured parts where Ga was detected in main phase grain | Frequency of measured parts where C was detected in main phase grain | Item G-1 | Item G-2 | Item G-3 |
|---|---|---|---|---|---|---|---|---|---|---|---|
| Samp. 51* | 0.01 | 0.96 | 5.96 | 13.7 | 15.5 | −3.9 | 10/10 | 10/10 | 0/10 | 0/10 | 0/10 |
| Samp. 52 | 0.05 | 0.59 | 1.99 | 13.7 | 16.8 | −1.2 | 10/10 | 10/10 | 10/10 | 8/10 | 8/10 |
| Samp. 32 | 0.10 | 0.49 | 1.49 | 13.7 | 20.3 | −0.5 | 10/10 | 10/10 | 10/10 | 10/10 | 10/10 |
| Samp. 53 | 0.15 | 0.45 | 1.32 | 13.7 | 21.2 | −0.3 | 10/10 | 10/10 | 10/10 | 10/10 | 10/10 |
| Samp. 54* | 0.30 | 0.27 | 0.66 | 13.6 | 16.3 | −3.6 | 10/10 | 10/10 | 0/10 | 0/10 | 0/10 |

| | Item G-4 | Item G-5 | Item C-1 | Item C-2 | Item C-3 | Item C-4 | Item C-5 | Item B-1 | Item B-2 | Item B-3 | Item B-4 | Item B-5 |
|---|---|---|---|---|---|---|---|---|---|---|---|---|
| Samp. 51* | 0/10 | 0/10 | 0/10 | 0/10 | 0/10 | 0/10 | 0/10 | 0/10 | 0/10 | 0/10 | 0/10 | 0/10 |
| Samp. 52 | 7/10 | 1/10 | 10/10 | 8/10 | 8/10 | 7/10 | 1/10 | 10/10 | 8/10 | 8/10 | 7/10 | 1/10 |
| Samp. 32 | 10/10 | 9/10 | 10/10 | 10/10 | 10/10 | 10/10 | 9/10 | 10/10 | 10/10 | 10/10 | 10/10 | 9/10 |
| Samp. 53 | 10/10 | 10/10 | 10/10 | 10/10 | 10/10 | 10/10 | 10/10 | 10/10 | 10/10 | 10/10 | 10/10 | 10/10 |
| Samp. 54* | 0/10 | 0/10 | 0/10 | 0/10 | 0/10 | 0/10 | 0/10 | 0/10 | 0/10 | 0/10 | 0/10 | 0/10 |

*comparative example

Table 6 shows that when the amount of oleic amide is 0.05 to 0.15 mass %, the composition of the outer edge part is favorably controlled, and the concentration ratio of Ga is easily in a favorable range.

Next, Sample No. 61 to Sample No. 63 were prepared in the same manner as Sample No. 11 except for changing a cooling rate after the end of Aging 2. Table 7 shows the results.

TABLE 7

| | Cooling rate of Aging 2 ° C./min | Magnetic properties: Residual magnetic flux density (Br) kG | Coercivity (HoJ) kOe | Thermal demagnetization factor % | Frequency of measured parts where Ga was detected in main phase grain | Frequency of measured parts where C was detected in main phase grain | Item G-1 | Item G-2 | Item G-3 |
|---|---|---|---|---|---|---|---|---|---|
| Samp. 23* | 25 | 14.0 | 16.1 | −4.0 | 10/10 | 10/10 | 0/10 | 0/10 | 0/10 |
| Samp. 19 | 50 | 14.0 | 16.5 | −2.2 | 10/10 | 10/10 | 9/10 | 6/10 | 0/10 |
| Samp. 13 | 75 | 13.5 | 17.8 | −0.9 | 10/10 | 10/10 | 9/10 | 7/10 | 7/10 |
| Samp. 12 | 100 | 13.6 | 17.8 | −0.9 | 10/10 | 10/10 | 10/10 | 8/10 | 8/10 |
| Samp. 11 | 125 | 13.6 | 18.0 | −0.9 | 10/10 | 10/10 | 10/10 | 9/10 | 9/10 |
| Samp. 10 | 150 | 13.5 | 18.1 | −0.8 | 10/10 | 10/10 | 10/10 | 9/10 | 9/10 |
| Samp. 61 | 200 | 13.5 | 17.7 | −0.9 | 10/10 | 10/10 | 10/10 | 8/10 | 8/10 |
| Samp. 62 | 250 | 13.4 | 17.3 | −1.1 | 10/10 | 10/10 | 9/10 | 7/10 | 6/10 |
| Samp. 63* | 300 | 13.1 | 15.3 | −4.2 | 10/10 | 10/10 | 0/10 | 0/10 | 0/10 |

| | Item G-4 | Item G-5 | Item C-1 | Item C-2 | Item C-3 | Item C-4 | Item C-5 | Item B-1 | Item B-2 | Item B-3 | Item B-4 | Item B-5 |
|---|---|---|---|---|---|---|---|---|---|---|---|---|
| Samp. 23* | 0/10 | 0/10 | 0/10 | 0/10 | 0/10 | 0/10 | 0/10 | 0/10 | 0/10 | 0/10 | 0/10 | 0/10 |
| Samp. 19 | 0/10 | 0/10 | 9/10 | 6/10 | 0/10 | 0/10 | 0/10 | 9/10 | 6/10 | 0/10 | 0/10 | 0/10 |
| Samp. 13 | 6/10 | 5/10 | 9/10 | 7/10 | 7/10 | 6/10 | 5/10 | 9/10 | 7/10 | 7/10 | 6/10 | 5/10 |
| Samp. 12 | 8/10 | 7/10 | 10/10 | 8/10 | 8/10 | 8/10 | 7/10 | 10/10 | 8/10 | 8/10 | 8/10 | 7/10 |
| Samp. 11 | 8/10 | 8/10 | 10/10 | 9/10 | 9/10 | 8/10 | 8/10 | 10/10 | 9/10 | 9/10 | 8/10 | 8/10 |
| Samp. 10 | 9/10 | 8/10 | 10/10 | 9/10 | 9/10 | 9/10 | 8/10 | 10/10 | 9/10 | 9/10 | 9/10 | 8/10 |
| Samp. 61 | 7/10 | 6/10 | 10/10 | 8/10 | 8/10 | 7/10 | 6/10 | 10/10 | 8/10 | 8/10 | 7/10 | 6/10 |
| Samp. 62 | 5/10 | 0/10 | 9/10 | 7/10 | 6/10 | 5/10 | 0/10 | 9/10 | 7/10 | 6/10 | 5/10 | 0/10 |
| Samp. 63* | 0/10 | 0/10 | 0/10 | 0/10 | 0/10 | 0/10 | 0/10 | 0/10 | 0/10 | 0/10 | 0/10 | 0/10 |

*comparative example

Table 7 shows that the Ga concentration ratio is easily in a favorable range when a cooling rate after the end of Aging 2 is 50° C./minute or more and 250° C./minute or less.

Furthermore, Sample No. 71 to Sample No. 80 were prepared in the same manner as Sample No. 2 except for changing a composition of the sintered magnet of Sample No. 2. Table 8 and Table 9 show the results.

TABLE 8

| | Composition of sintered magnet (mass %): R | | | | | | M | | | | | | |
|---|---|---|---|---|---|---|---|---|---|---|---|---|---|
| | Total | Nd | Pr | Dy | B | Cu | Al | Ga | Si | Ge | Sn | Co | Fe |
| Samp. 2 | 32.0 | 26.0 | 6.0 | 0.0 | 0.87 | 0.1 | 0.2 | 0.5 | 0.0 | 0.0 | 0.0 | 0.5 | bal. |
| Samp. 71 | 32.0 | 25.5 | 6.0 | 0.5 | 0.87 | 0.1 | 0.2 | 0.5 | 0.0 | 0.0 | 0.0 | 0.5 | bal. |
| Samp. 6 | 32.0 | 25.0 | 6.0 | 1.0 | 0.87 | 0.1 | 0.2 | 0.5 | 0.0 | 0.0 | 0.0 | 0.5 | bal. |
| Samp. 72 | 32.0 | 24.0 | 6.0 | 2.0 | 0.87 | 0.1 | 0.2 | 0.5 | 0.0 | 0.0 | 0.0 | 0.5 | bal. |
| Samp. 73 | 32.0 | 26.0 | 6.0 | 0.0 | 0.80 | 0.1 | 0.2 | 0.5 | 0.0 | 0.0 | 0.0 | 0.5 | bal. |
| Samp. 3 | 32.0 | 26.0 | 6.0 | 0.0 | 0.84 | 0.1 | 0.2 | 0.5 | 0.0 | 0.0 | 0.0 | 0.5 | bal. |
| Samp. 2 | 32.0 | 26.0 | 6.0 | 0.0 | 0.87 | 0.1 | 0.2 | 0.5 | 0.0 | 0.0 | 0.0 | 0.5 | bal. |
| Samp. 74 | 32.0 | 26.0 | 6.0 | 0.0 | 0.87 | 0.01 | 0.2 | 0.5 | 0.0 | 0.0 | 0.0 | 0.5 | bal. |
| Samp. 75 | 32.0 | 26.0 | 6.0 | 0.0 | 0.87 | 0.05 | 0.2 | 0.5 | 0.0 | 0.0 | 0.0 | 0.5 | bal. |
| Samp. 2 | 32.0 | 26.0 | 6.0 | 0.0 | 0.87 | 0.1 | 0.2 | 0.5 | 0.0 | 0.0 | 0.0 | 0.5 | bal. |
| Samp. 76 | 32.0 | 26.0 | 6.0 | 0.0 | 0.87 | 1.5 | 0.2 | 0.5 | 0.0 | 0.0 | 0.0 | 0.5 | bal. |
| Samp. 77 | 32.0 | 26.0 | 6.0 | 0.0 | 0.87 | 0.1 | 0.0 | 0.03 | 0.0 | 0.0 | 0.0 | 0.5 | bal. |
| Samp. 2 | 32.0 | 26.0 | 6.0 | 0.0 | 0.87 | 0.1 | 0.2 | 0.5 | 0.0 | 0.0 | 0.0 | 0.5 | bal. |
| Samp. 4 | 32.0 | 26.0 | 6.0 | 0.0 | 0.87 | 0.1 | 0.2 | 0.8 | 0.0 | 0.0 | 0.0 | 0.5 | bal. |
| Samp. 78 | 32.0 | 26.0 | 6.0 | 0.0 | 0.87 | 0.1 | 0.2 | 0.5 | 0.0 | 0.0 | 0.0 | 0.3 | bal. |
| Samp. 2 | 32.0 | 26.0 | 6.0 | 0.0 | 0.87 | 0.1 | 0.2 | 0.5 | 0.0 | 0.0 | 0.0 | 0.5 | bal. |
| Samp. 79 | 32.0 | 26.0 | 6.0 | 0.0 | 0.87 | 0.1 | 0.2 | 0.5 | 0.0 | 0.0 | 0.0 | 2.5 | bal. |
| Samp. 80 | 32.0 | 26.0 | 6.0 | 0.0 | 0.87 | 0.1 | 0.2 | 0.5 | 0.0 | 0.0 | 0.0 | 3.0 | bal. |

TABLE 8-continued

| | Magnetic properties | | | Frequency of | Frequency of |
|---|---|---|---|---|---|
| | Residual magnetic flux density (Br) kG | Coercivity (HcJ) kOe | Thermal demagnetization factor % | measured parts where Ga was detected in main phase grain | measured parts where C was detected in main phase grain |
| Samp. 2 | 13.7 | 21.5 | −0.3 | 10/10 | 10/10 |
| Samp. 71 | 13.6 | 21.7 | −0.4 | 10/10 | 10/10 |
| Samp. 6 | 13.5 | 21.9 | −0.5 | 10/10 | 10/10 |
| Samp. 72 | 13.2 | 22.2 | −0.7 | 10/10 | 10/10 |
| Samp. 73 | 13.5 | 17.8 | −0.8 | 10/10 | 10/10 |
| Samp. 3 | 13.5 | 21.5 | −0.4 | 10/10 | 10/10 |
| Samp. 2 | 13.7 | 21.5 | −0.3 | 10/10 | 10/10 |
| Samp. 74 | 13.7 | 16.2 | −1.2 | 10/10 | 10/10 |
| Samp. 75 | 13.7 | 21.3 | −0.3 | 10/10 | 10/10 |
| Samp. 2 | 13.7 | 21.5 | −0.3 | 10/10 | 10/10 |
| Samp. 76 | 13.3 | 22.3 | −0.3 | 10/10 | 10/10 |
| Samp. 77 | 13.7 | 17.9 | −0.9 | 10/10 | 10/10 |
| Samp. 2 | 13.7 | 21.5 | −0.3 | 10/10 | 10/10 |
| Samp. 4 | 13.3 | 21.3 | −0.3 | 10/10 | 10/10 |
| Samp. 78 | 13.7 | 21.6 | −0.3 | 10/10 | 10/10 |
| Samp. 2 | 13.7 | 21.5 | −0.3 | 10/10 | 10/10 |
| Samp. 79 | 13.6 | 20.7 | −0.2 | 10/10 | 10/10 |
| Samp. 80 | 13.5 | 19.8 | −0.6 | 10/10 | 10/10 |

TABLE 9

| | Item G-1 | Item G-2 | Item G-3 | Item G-4 | Item G-5 | Item C-1 | Item C-2 | Item C-3 | Item C-4 | Item C-5 | Item B-1 | Item B-2 | Item B-3 | Item B-4 | Item B-5 |
|---|---|---|---|---|---|---|---|---|---|---|---|---|---|---|---|
| Samp. 2 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 71 | 10/10 | 10/10 | 10/10 | 10/10 | 9/10 | 10/10 | 10/10 | 10/10 | 10/10 | 9/10 | 10/10 | 10/10 | 10/10 | 10/10 | 9/10 |
| Samp. 6 | 10/10 | 10/10 | 9/10 | 8/10 | 7/10 | 10/10 | 10/10 | 9/10 | 8/10 | 7/10 | 10/10 | 10/10 | 9/10 | 8/10 | 7/10 |
| Samp. 72 | 10/10 | 9/10 | 9/10 | 8/10 | 7/10 | 10/10 | 9/10 | 9/10 | 8/10 | 7/10 | 10/10 | 9/10 | 9/10 | 8/10 | 7/10 |
| Samp. 73 | 10/10 | 9/10 | 10/10 | 9/10 | 9/10 | 10/10 | 9/10 | 10/10 | 9/10 | 9/10 | 10/10 | 9/10 | 10/10 | 9/10 | 9/10 |
| Samp. 3 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 2 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 74 | 9/10 | 7/10 | 6/10 | 6/10 | 0/10 | 9/10 | 7/10 | 6/10 | 6/10 | 0/10 | 9/10 | 7/10 | 6/10 | 6/10 | 0/10 |
| Samp. 75 | 10/10 | 10/10 | 10/10 | 9/10 | 8/10 | 10/10 | 10/10 | 10/10 | 9/10 | 8/10 | 10/10 | 10/10 | 10/10 | 9/10 | 8/10 |
| Samp. 2 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 76 | 10/10 | 10/10 | 10/10 | 10/10 | 8/10 | 10/10 | 10/10 | 10/10 | 10/10 | 8/10 | 10/10 | 10/10 | 10/10 | 10/10 | 8/10 |
| Samp. 77 | 9/10 | 7/10 | 7/10 | 7/10 | 5/10 | 9/10 | 7/10 | 7/10 | 7/10 | 5/10 | 9/10 | 7/10 | 7/10 | 7/10 | 5/10 |
| Samp. 2 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 4 | 10/10 | 10/10 | 10/10 | 9/10 | 9/10 | 10/10 | 10/10 | 10/10 | 9/10 | 9/10 | 10/10 | 10/10 | 10/10 | 9/10 | 9/10 |
| Samp. 78 | 10/10 | 10/10 | 10/10 | 10/10 | 9/10 | 10/10 | 10/10 | 10/10 | 10/10 | 9/10 | 10/10 | 10/10 | 10/10 | 10/10 | 9/10 |
| Samp. 2 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 79 | 10/10 | 10/10 | 10/10 | 10/10 | 10/10 | 10/10 | 10/10 | 10/10 | 10/10 | 10/10 | 10/10 | 10/10 | 10/10 | 10/10 | 10/10 |
| Samp. 80 | 10/10 | 10/10 | 10/10 | 10/10 | 8/10 | 10/10 | 10/10 | 10/10 | 10/10 | 8/10 | 10/10 | 10/10 | 10/10 | 10/10 | 8/10 |

The present invention has been accordingly explained based on the embodiment. The embodiment is an example, and a person skilled in the art understands that variations and modifications are possible within the scope of the claims of the present invention, and that these variations and modifications are in the scope of the claims of the present invention. Therefore, the statements and the drawings of the present description should be handled in an illustrative manner, not in a limited manner.

INDUSTRIAL APPLICABILITY

The present invention can provide a rare earth magnet applicable even in high temperature environment.

REFERENCE SIGNS LIST

1 main phase grain
2 grain boundary phase
5 sample cut-out part
11 50 nm length outer edge part
12*a*, 12*b* main phase grain edge part

The invention claimed is:

1. A rare earth magnet comprising main phase grains having an $R_2T_{14}B$ type crystal structure, and comprising R: 29.5 to 35.0 mass %; B: 0.87 to 0.98 mass %; M: 0.03 to 1.7 mass %; Cu: 0.01 to 1.5 mass %; Fe: substantial remaining part; total content of element(s) other than Fe occupying the remaining part: 5.0 mass % or less, wherein M is Ga: 0.03 to 1.5 mass %; and one or more elements selected from the group consisting of Al, Si, Ge and Sn, and wherein an atom concentration ratio A ($A=\alpha Ga/\beta Ga$) of the main phase grains is 1.50 or more, where $\alpha Ga$ and $\beta Ga$ are respectively a highest concentration of Ga and a lowest concentration of Ga in one main phase grain, and an absolute value of thermal demagnetization factor is 0.5% or less.

2. The rare earth magnet according to claim 1, wherein a position showing $\beta Ga$ is located within 100 nm from an edge part of the main phase grain toward an inner part of the main phase grain.

3. The rare earth magnet according to claim 1, wherein the main phase grain comprises a concentration gradient of Ga increasing from an edge part of the main phase grain toward an inner part of the main phase grain, and a region with the concentration gradient of Ga has a length of 100 nm or more.

4. The rare earth magnet according to claim 1, wherein the main phase grain comprises a concentration gradient of Ga increasing from an edge part of the main phase grain toward an inner part of the main phase grain, and a region whose absolute value of the concentration gradient of Ga is 0.05 atom %/μm or more has a length of 100 nm or more.

5. The rare earth magnet according to claim 1, wherein 0.05 atom % or more of C is detected in all main phase grains in an area 100 nm or more from an edge part of each main phase grain toward an inner part of each main phase grain.

6. The rare earth magnet according to claim 1, wherein R includes both Nd and Pr, and each of a ratio of Nd in R and a ratio of Pr in R is 10 mass % or more.

7. The rare earth magnet according to claim 1, wherein a relation of $1.20<[M]/[C]<2.00$ is satisfied, where [C] and [M] are the number of atoms of C and M elements present in the magnet.

8. The rare earth magnet according to claim 2, wherein the main phase grain comprises a concentration gradient of Ga increasing from an edge part of the main phase grain toward an inner part of the main phase grain, and a region with the concentration gradient of Ga has a length of 100 nm or more.

9. The rare earth magnet according to claim 2, wherein the main phase grain comprises a concentration gradient of Ga increasing from an edge part of the main phase grain toward an inner part of the main phase grain, and a region whose absolute value of the concentration gradient of Ga is 0.05 atom %/μm or more has a length of 100 nm or more.

10. The rare earth magnet according to claim 3, wherein the main phase grain comprises a concentration gradient of Ga increasing from an edge part of the main phase grain toward an inner part of the main phase grain, and a region whose absolute value of the concentration gradient of Ga is 0.05 atom %/μm or more has a length of 100 nm or more.

11. The rare earth magnet according to claim 8, wherein the main phase grain comprises a concentration gradient of Ga increasing from an edge part of the main phase grain toward an inner part of the main phase grain, and a region whose absolute value of the concentration gradient of Ga is 0.05 atom %/μm or more has a length of 100 nm or more.

* * * * *